US007690442B2

(12) United States Patent
Portwood et al.

(10) Patent No.: US 7,690,442 B2
(45) Date of Patent: Apr. 6, 2010

(54) DRILL BIT AND CUTTING INSERTS FOR HARD/ABRASIVE FORMATIONS

(75) Inventors: Gary Portwood, Livorno (IT); Peter Wilson, Norman, OK (US); Luca Tedeschi, Provincia di Pisa (IT); Bryce Baker, Houston, TX (US); Daniel W. Brietzke, Richmond, TX (US)

(73) Assignee: Smith International, Inc., Houston, TX (US)

( * ) Notice: Subject to any disclaimer, the term of this patent is extended or adjusted under 35 U.S.C. 154(b) by 553 days.

(21) Appl. No.: 11/383,584

(22) Filed: May 16, 2006

(65) Prior Publication Data

US 2006/0260846 A1 Nov. 23, 2006

Related U.S. Application Data

(60) Provisional application No. 60/681,692, filed on May 17, 2005.

(51) Int. Cl.
*E21B 10/16* (2006.01)

(52) U.S. Cl. ..... 175/57; 175/331; 175/426; 76/108.4

(58) Field of Classification Search ..... 175/331, 175/426, 57; 76/108.4
See application file for complete search history.

(56) References Cited

U.S. PATENT DOCUMENTS

| | | | |
|---|---|---|---|
| 2,578,593 | A | 12/1951 | Phipps |
| 3,388,757 | A | 6/1968 | Fittinger |
| 3,442,352 | A | 5/1969 | McElya et al. |
| 3,946,820 | A | 3/1976 | Knapp |
| 4,056,153 | A | 11/1977 | Miglierini |
| 4,058,177 | A | 11/1977 | Langford, Jr. et al. |
| 4,086,973 | A | 5/1978 | Keller et al. |
| 4,108,260 | A | 8/1978 | Bozarth |
| 4,334,586 | A | 6/1982 | Schumacher |
| 4,352,400 | A | 10/1982 | Grappendorf et al. |
| 4,359,113 | A | 11/1982 | Morris |
| 4,511,006 | A | 4/1985 | Grainger |
| 4,586,574 | A | 5/1986 | Grappendorf |

(Continued)

FOREIGN PATENT DOCUMENTS

| | | |
|---|---|---|
| EP | 0 391 683 | 10/1990 |

(Continued)

OTHER PUBLICATIONS

Combined Search and Examination Report for British Appl. No. GB0609715.8 dated Sep. 15, 2006; (6 p.).

(Continued)

*Primary Examiner*—Shane Bomar
(74) *Attorney, Agent, or Firm*—Conley Rose, P.C.

(57) ABSTRACT

A rolling cone drill bit comprises a plurality of bottomhole cutter elements positioned in a first circumferential row, wherein at least one of the cutter elements comprises a cutting portion extending from a base portion to a point furthermost from the base portion, defining an extension height. The ratio of the cross-sectional area of the cutter element at a point equal to ninety-four percent of the extension height to the cross-sectional area of the cutter element base is greater than 0.2. Moreover, the ratio of the extension height to the base diameter is not greater than 0.75.

53 Claims, 14 Drawing Sheets

U.S. PATENT DOCUMENTS 4,604,106 A 8/1986 Hall et al.
4,629,373 A 12/1986 Hall
4,694,918 A 9/1987 Hall
4,716,977 A 1/1988 Huffstutler
4,722,405 A 2/1988 Langford, Jr.
4,811,801 A 3/1989 Salesky et al.
4,832,139 A 5/1989 Minikus et al.
4,951,762 A 8/1990 Lundell
D324,527 S 3/1992 Slutz
5,131,478 A 7/1992 Brett et al.
5,131,481 A 7/1992 Smith
5,172,777 A 12/1992 Siracki et al.
5,172,779 A 12/1992 Siracki et al.
5,197,555 A 3/1993 Estes
5,201,376 A 4/1993 Williams
5,303,787 A 4/1994 Brady
5,322,138 A * 6/1994 Siracki ..... 175/374
5,323,865 A 6/1994 Isbell et al.
5,341,890 A 8/1994 Cawthorne et al.
5,351,768 A 10/1994 Scott et al.
5,351,770 A 10/1994 Cawthorne et al.
5,372,210 A 12/1994 Harrell
5,379,854 A 1/1995 Dennis
5,407,022 A 4/1995 Scott et al.
5,415,244 A 5/1995 Portwood
5,421,423 A 6/1995 Huffstutler
5,421,424 A * 6/1995 Portwood et al. ..... 175/374
5,429,199 A 7/1995 Sheirer et al.
5,429,200 A 7/1995 Blackman et al.
5,452,771 A 9/1995 Blackman et al.
5,467,669 A 11/1995 Stroud
5,479,997 A 1/1996 Scott et al.
5,518,077 A 5/1996 Blackman et al.
5,535,839 A 7/1996 Brady
5,542,485 A 8/1996 Pessier et al.
5,560,440 A 10/1996 Tibbits
5,592,995 A 1/1997 Scott et al.
5,630,479 A * 5/1997 Dennis ..... 175/426
5,636,700 A 6/1997 Shamburger, Jr.
5,644,956 A 7/1997 Blackman et al.
5,695,019 A 12/1997 Shamburger, Jr.
5,697,462 A 12/1997 Grimes et al.
5,709,278 A 1/1998 Crawford
5,743,346 A 4/1998 Flood et al.
5,746,280 A 5/1998 Scott et al.
5,752,573 A 5/1998 Scott et al.
5,755,301 A 5/1998 Love et al.
5,766,394 A 6/1998 Anderson et al.
5,813,485 A 9/1998 Portwood
5,819,861 A 10/1998 Scott et al.
5,833,020 A 11/1998 Portwood et al.
5,839,526 A 11/1998 Cisneros et al.
5,871,060 A 2/1999 Jensen et al.
5,874,060 A 2/1999 Armour et al.
5,881,828 A 3/1999 Fischer et al.
5,887,655 A 3/1999 Haugen et al.
5,887,668 A 3/1999 Haugen et al.
5,890,550 A 4/1999 Swadi et al.
5,915,486 A 6/1999 Portwood et al.
5,950,745 A 9/1999 Ingmarsson
5,967,245 A 10/1999 Garcia et al.
6,029,759 A 2/2000 Sue et al.
6,053,263 A * 4/2000 Meiners ..... 175/331
6,059,054 A 5/2000 Portwood et al.
6,105,693 A 8/2000 Ingmarsson
6,105,694 A 8/2000 Scott
D430,578 S 9/2000 Brady
6,119,798 A 9/2000 Fischer et al.
6,170,583 B1 * 1/2001 Boyce ..... 175/426
6,176,332 B1 1/2001 Massa et al.
6,176,333 B1 1/2001 Doster
6,196,340 B1 3/2001 Jensen et al.
6,199,645 B1 * 3/2001 Anderson et al. ..... 175/426
6,202,752 B1 3/2001 Kuck et al.
6,227,318 B1 * 5/2001 Siracki ..... 175/430
6,241,034 B1 6/2001 Steinke et al.
6,367,568 B2 4/2002 Steinke et al.
6,460,636 B1 * 10/2002 Yong et al. ..... 175/428
6,561,293 B2 5/2003 Minikus et al.
6,595,305 B1 7/2003 Dunn et al.
6,601,662 B2 8/2003 Matthias et al.
6,640,913 B2 * 11/2003 Lockstedt et al. ..... 175/331
6,745,645 B2 6/2004 Griffo
6,782,959 B2 8/2004 Minikus et al.
6,883,623 B2 4/2005 McCormick et al.
6,883,624 B2 4/2005 McDonough
7,011,169 B2 3/2006 Eason
7,152,703 B2 * 12/2006 Meiners et al. ..... 175/426
2001/0004026 A1 6/2001 Lockstedt et al.
2002/0108789 A1 8/2002 Schautt
2004/0149493 A1 8/2004 Mcdonough
2004/0163851 A1 8/2004 McDonough et al.
2004/0173384 A1 9/2004 Yong et al.
2005/0023043 A1 2/2005 Tufts

FOREIGN PATENT DOCUMENTS

EP 0 446 765 9/1991
EP 0 527 506 2/1993
EP 0 902 159 3/1999
GB 2 361 497 10/2001
GB 2 369 841 6/2002
GB 2 393 982 4/2004
GB 2 398 830 8/2004
RU 2087666 10/1995
RU 2105124 2/1998
RU 2153569 7/2000
WO WO 01/61142 8/2001

OTHER PUBLICATIONS

Search Report for Appln. No. GB0416617.9 dated Sep. 10, 2004 (3 p.).
Search Report for Appln. No. GB0402108.5 dated Apr. 23, 2004 (3 p.).
Search Report for Appln. No. GB0404709.8 dated Sep. 24, 2004 (2 p.).
Search Report for Appln. No. GB0403620.8 dated May 6, 2004 (5 p.).

* cited by examiner 24
11
10
19
14
22
28
26
19a
31
20
30
34
32
5
40
60
42
44
70
50
83
6
80
81
7
82'
82
46

DRILL BIT AND CUTTING INSERTS FOR HARD/ABRASIVE FORMATIONS

CROSS-REFERENCE TO RELATED APPLICATIONS

The present application claims the benefit of 35 U.S.C. 111(b) provisional application Ser. No. 60/681,692 filed May 17, 2005, and entitled Drill Bit and Cutting Inserts For Hard/Abrasive Formations.

STATEMENT REGARDING FEDERALLY SPONSORED RESEARCH OR DEVELOPMENT

Not Applicable.

BACKGROUND OF THE INVENTION

The invention relates generally to earth-boring bits used to drill a borehole for the ultimate recovery of oil, gas or minerals. More particularly, the invention relates to rolling cone rock bits and to an improved cutting structure for such bits. Still more particularly, the invention relates to enhancements in cutter element geometry, to increase bit durability and rate of penetration and enhance the bit's ability to maintain gage in hard and abrasive formations.

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole formed in the drilling process will have a diameter generally equal to the diameter or "gage" of the drill bit.

A typical earth-boring bit includes one or more rotatable cutters that perform their cutting function due to the rolling movement of the cutters acting against the formation material. The cutters roll and slide upon the bottom of the borehole as the bit is rotated, the cutters thereby engaging and disintegrating the formation material in its path. The rotatable cutters may be described as generally conical in shape and are therefore sometimes referred to as rolling cones. The borehole is formed as the gouging and scraping or crushing and chipping action of the rotary cones remove chips of formation material which are carried upward and out of the borehole by drilling fluid which is pumped downwardly through the drill pipe and out of the bit.

The earth disintegrating action of the rolling cone cutters is enhanced by providing the cutters with a plurality of cutter elements. Cutter elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits or "insert" bits, while those having teeth formed from the cone material are known as "steel tooth bits." In each instance, the cutter elements on the rotating cutters break up the formation to form a new borehole by a combination of gouging and scraping or chipping and crushing.

In oil and gas drilling, the cost of drilling a borehole is proportional to the length of time it takes to drill to the desired depth and location. The time required to drill the well, in turn, is greatly affected by the number of times the drill bit must be changed in order to reach the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits which will drill faster and longer and which are usable over a wider range of formation hardness.

The length of time that a drill bit may be employed before it must be changed depends upon its rate of penetration ("ROP"), as well as its durability. The form and positioning of the cutter elements upon the cone cutters greatly impact bit durability and ROP, and thus are critical to the success of a particular bit design.

Bit durability is, in part, measured by a bit's ability to "hold gage," meaning its ability to maintain a full gage borehole diameter over the entire length of the borehole. Gage holding ability is particularly vital in directional drilling applications which have become increasingly important. If gage is not maintained at a relatively constant dimension, it becomes more difficult, and thus more costly, to insert drilling apparatus into the borehole than if the borehole had a constant diameter. For example, when a new, unworn bit is inserted into an undergage borehole, the new bit will be required to ream the undergage hole as it progresses toward the bottom of the borehole. Thus, by the time it reaches the bottom, the bit may have experienced a substantial amount of wear that it would not have experienced had the prior bit been able to maintain full gage. Such wear will shorten the life of the newly-inserted bit, thus prematurely requiring the time consuming and expensive process of removing the drill string, replacing the worn bit, and reinstalling another new bit downhole.

To assist in maintaining the gage of a borehole, conventional rolling cone bits typically employ a heel row of hard metal inserts on the heel surface of the rolling cone cutters. The heel surface is a generally frustoconical surface and is configured and positioned so as to generally align with and ream the sidewall of the borehole as the bit rotates. The inserts in the heel surface contact the borehole wall with a sliding motion and thus generally may be described as scraping or reaming the borehole sidewall. The heel inserts function primarily to maintain a constant gage and secondarily to prevent the erosion and abrasion of the heel surface of the rolling cone. Excessive wear of the heel inserts leads to an undergage borehole, decreased ROP, increased loading on the other cutter elements on the bit, and may accelerate wear of the cutter bearing, and ultimately lead to bit failure.

Conventional bits also typically include one or more rows of gage cutter elements. Gage row elements are mounted adjacent to the heel surface but orientated and sized in such a manner so as to cut the corner of the borehole. In this orientation, the gage cutter elements generally are required to cut both the borehole bottom and sidewall. The lower surface of the gage row cutter elements engage the borehole bottom while the radially outermost surface scrapes the sidewall of the borehole.

Conventional bits also include a number of additional rows of cutter elements that are located on the cones in rows disposed radially inward from the gage row. These cutter elements are sized and configured for cutting the bottom of the borehole and are typically described as inner row cutter elements. In many applications, inner row cutter elements are relatively long and sharper than those typically employed in the gage row or the heel row where the inserts ream the sidewall of the borehole and cut formation via a scraping or shearing action. By contrast, the inner row cutters are intended to penetrate and remove formation material by gouging and fracturing formation material. Consequently, particularly in softer formations, it is desirable that the inner row inserts have a relatively large extension height above the cone steel to facilitate rapid removal of formation material from the bottom of the borehole. However, in hard formations, such longer extensions make the inserts more susceptible to failure due to breakage. Thus, in hard formations, it is common to have relatively short extensions. Nevertheless, it has been conventional practice to employ relatively sharp geometry on the inserts in the hard rock formations in order to better penetrate the formation material. Common cutter shapes for inner row and gage row inserts for hard formations are chisel and conical shapes. Although such inserts with their shorter extensions have generally avoided breakage problems associated with longer and more aggressive inserts, and although the relativity sharp chisel and conical shapes provide reasonable rates of penetration and bit life they tend wear at a fast rate in hard abrasive formations because of the sharp tip geometry which reduces the footage drilled. Increasing ROP while maintaining good cutter and bit life to increase the footage drilled is still an important goal so as to decrease drilling time and recover valuable oil and gas more economically.

Accordingly, there remains a need in the art for a drill bit and cutting structure that, in relatively hard and/or highly abrasive formations, will yield an increase in ROP and footage drilled, while maintaining a full gage borehole.

SUMMARY OF THE PREFERRED EMBODIMENTS

These and other needs in the art are addressed in one embodiment by a rolling cone drill bit for drilling a borehole in earthen formations. In an embodiment, the bit comprises a bit body having a bit axis. In addition, the bit comprises at least one rolling cone cutter mounted on the bit body for rotation about a cone axis and having a first surface for cutting the borehole bottom and second surface for cutting the borehole sidewall. Further, the bit comprises a plurality of cutter elements secured to the cone cutter and extending from the first surface and positioned in a first circumferential row, wherein at least one of the cutter elements comprises a cutter element axis, a base portion having a diameter, and a cutting portion extending from the base portion to a point furthermost from the base portion defining an extension height. Still further, the ratio of the cross-sectional area of the cutter element defined by a plane perpendicular to the cutter element axis at a point equal to ninety-four percent of the extension height to the cross-sectional area of the cutter element base defined by a plane perpendicular to the cutter element axis is greater than 0.2. Moreover, the ratio of the extension height to the base diameter is not greater than 0.75.

These and other needs in the art are addressed in another embodiment by a rolling cone drill bit for drilling through earthen formations to form a borehole with a hole bottom and a sidewall. In an embodiment, the drill bit comprises at least one rolling cone cutter rotatably mounted on a bit body, the rolling cone cutter including a first surface generally facing the borehole bottom and a second surface generally facing the sidewall of the borehole. In addition, the drill bit comprises at least one cutter element mounted in the rolling cone cutter and secured in a position to cut against the borehole bottom, wherein the at least one cutter element including a base portion and a cutting portion extending from the base portion to a cutting tip, the cutting portion tapering from the base portion to the cutting tip and defining an extension height. Still further, the at least one cutter element has a tip-to-base volume ratio of at least 0.17.

These and other needs in the art are addressed in another embodiment by a rolling cone drill bit for drilling through earthen formations to form a borehole having a hole bottom and a hole sidewall. In an embodiment, the drill bit comprises at least one rolling cone cutter rotatably mounted on a bit body for rotation about a cone axis. In addition, the bit comprises a plurality of inner row cutter elements mounted in the cone cutter in a first circumferential row, the inner row cutter having a generally conical cutting portion extending from a cylindrical base to a cutting tip and defining an extension height, wherein the extension height is not greater than 0.75. Further, the bit comprises a plurality of gage row cutter elements mounted in the cone cutter in a second circumferential row, the gage row cutter elements having a cutting portion extending from a generally cylindrical base to a cutting tip and defining an extension height, wherein the extension height of the gage row cutter elements are not greater than 0.5. Still further, the plurality of inner row cutter elements and a plurality of gage row cutter elements each include a tip-to-base volume ratio of at least 0.17.

These and other needs in the art are addressed in another embodiment by a method of designing a rolling cone drill bit for forming a borehole. In an embodiment, the method comprises selecting a rolling cone cutter. In addition, the method comprises selecting a location on the rolling cone cutter for mounting a cutting insert having a base portion retained in the cone cutter and a cutting portion extending therefrom to cut a portion of the borehole bottom. Further, the method comprises selecting the diameter for the base portion. Still further, the method comprises selecting the extension height for the cutting portion. Moreover, the method comprises selecting the geometry of the cutting portion such that the cutting insert has a tip volume of at least 0.0010 $in^3$.

These and other needs in the art are addressed in another embodiment by a rolling cone drill bit for drilling through earthen formations to form a borehole with a hole bottom and a sidewall. In an embodiment, the drill bit comprises at least one rolling cone cutter rotatably mounted on a bit body, the rolling cone cutter including a first surface generally facing the borehole bottom and a second surface generally facing the sidewall of the borehole. In addition, the drill bit comprises at least one cutter element mounted in the rolling cone cutter and secured in a position to cut against the borehole bottom, wherein the at least one cutter element including a cutter element axis, a base portion and a cutting portion extending from the base portion to a point furthermost from the base portion defining an extension height. Further, the at least one cutter element has a tip-to-base volume ratio of at least 0.30.

The inserts described herein are intended for hard and/or abrasive formations to provide enhanced ROP, durability and reduced wear rate relative to cutter elements having conventional shapes and geometries.

The embodiments described herein thus comprise a combination of features and characteristics intended to address various shortcomings of prior bits and inserts. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1:
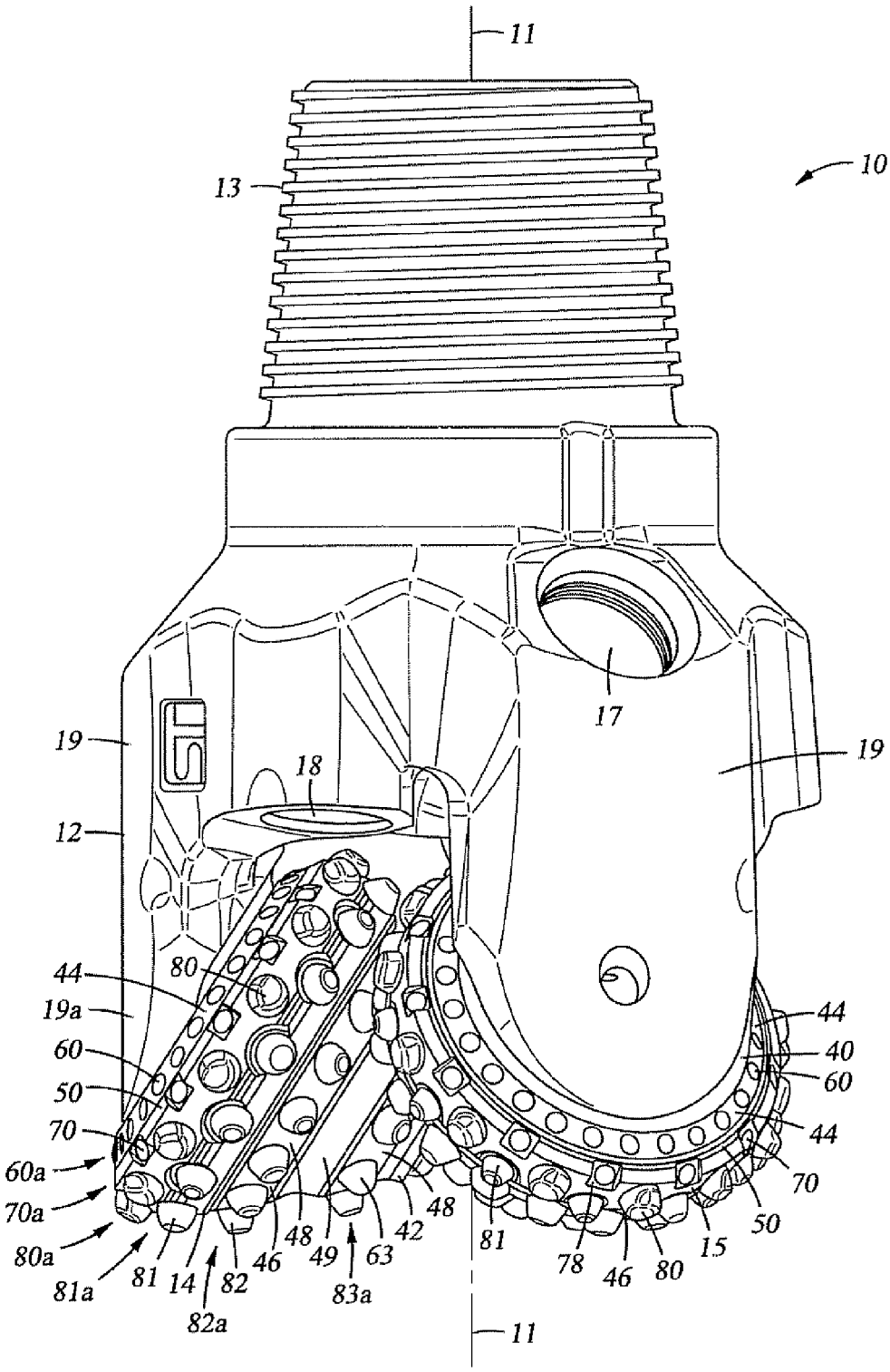
FIG. 1 is a perspective view of an earth-boring bit made in accordance with the principles of the present invention.

Referring first to FIG. 1, an earth-boring bit 10 includes a central axis 11 and a bit body 12 having a threaded section 13 on its upper end for securing the bit to the drill string (not shown). Bit 10 has a predetermined gage diameter as defined by three rolling cone cutters 14, 15, 16 (two shown in FIG. 1) rotatably mounted on bearing shafts that depend from the bit body 12. Bit body 12 is composed of three sections or legs 19 (two shown in FIG. 1) that are welded together to form bit body 12. Bit 10 further includes a plurality of nozzles 18 that are provided for directing drilling fluid toward the bottom of the borehole and around cone cutters 14-16, and lubricant reservoirs 17 that supply lubricant to the bearings of each of the cutters. Bit legs 19 include a shirttail portion 19*a* that serves to protect cone bearings and seals from damage caused by cuttings and debris entering between the leg 19 and its respective cone cutters.

Figure 2:
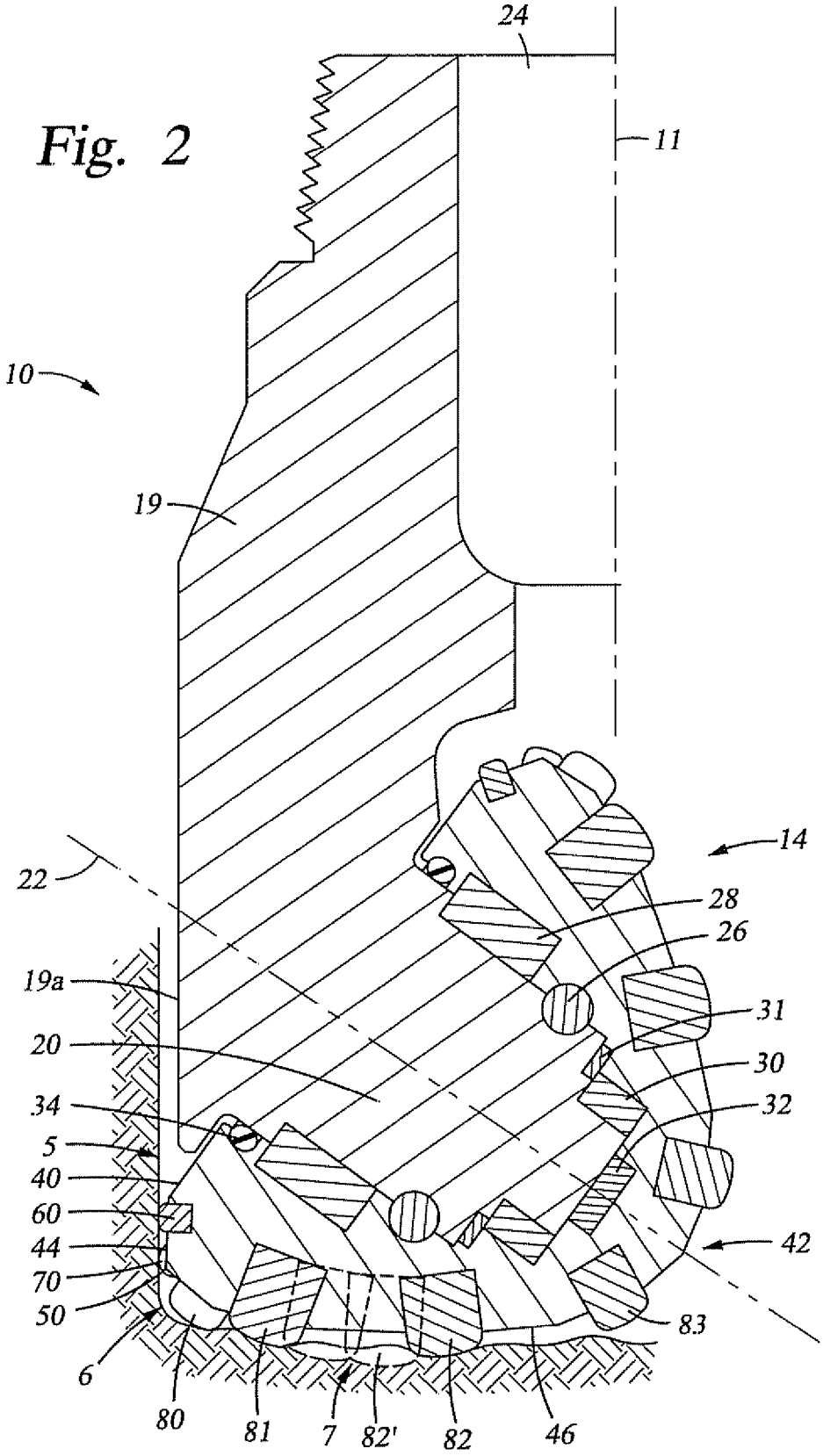
FIG. 2 is a partial section view taken through one leg and one rolling cone cutter of the bit shown in FIG. 1.

Referring now to FIG. 2, in conjunction with FIG. 1, each cone cutter 14-16 is rotatably mounted on a pin or journal 20, with an axis of rotation 22 oriented generally downwardly and inwardly toward the center of the bit. Drilling fluid is pumped from the surface through fluid passage 24 where it is circulated through an internal passageway (not shown) to nozzles 18 (FIG. 1). Each cone cutter 14-16 is typically secured on pin 20 by locking balls 26. In the embodiment shown, radial and axial thrust are absorbed by roller bearings 28, 30, thrust washer 31 and thrust plug 32; however, the invention is not limited to use in a roller bearing bit, but may equally be applied in a friction bearing bit, where cone cutters 14-16 would be mounted on pins 20 without roller bearings 28, 30. In both roller bearing and friction bearing bits, lubricant may be supplied from reservoir 17 to the bearings by apparatus that is omitted from the figures for clarity. The lubricant is sealed and drilling fluid excluded by means of an annular seal 34. The borehole created by bit 10 includes sidewall 5, corner portion 6 and bottom 7, best shown in FIG. 2.

Referring still to FIGS. 1 and 2, each cone cutter 14-16 includes a backface 40 and nose portion 42. Further, each cone cutter 14-16 includes a generally frustoconical surface 44 that is adapted to retain cutter elements that scrape or ream the sidewalls of the borehole as cone cutters 14-16 rotate about the borehole bottom. Frustoconical surface 44 will be referred to herein as the "heel" surface of cone cutters 14-16, it being understood, however, that the same surface may be sometimes referred to by others in the art as the "gage" surface of a rolling cone cutter.

Extending between heel surface 44 and nose 42 is a generally conical surface 46 adapted for supporting cutter elements that gouge or crush the borehole bottom 7 as the cone cutters 14-16 rotate about the borehole. Conical surface 46 typically includes a plurality of generally frustoconical segments 48 generally referred to as "lands" which are employed to support and secure the cutter elements as described in more detail below. Grooves 49 are formed in cone surface 46 between adjacent lands 48. Frustoconical heel surface 44 and conical surface 46 converge in a circumferential edge or shoulder 50. Although referred to herein as an "edge" or "shoulder," it should be understood that shoulder 50 may be contoured, such as a radius, to various degrees such that shoulder 50 will define a contoured zone of convergence between frustoconical heel surface 44 and the conical surface 46.

In the embodiment of the invention shown in FIGS. 1 and 2, each cone cutter 14-16 includes a plurality of wear resistant cutting elements or inserts 60, 70, 80. Exemplary cone cutter 14 illustrated in FIG. 2 includes a plurality of heel row inserts 60 that are secured in a circumferential row 60*a* in the frustoconical heel surface 44. Cone cutter 14 further includes a circumferential row 70*a* of nestled gage inserts 70 secured to cone cutter 14 in locations along or near the circumferential shoulder 50, and a row 80*a* of gage inserts 80 on surface 46. Inserts 70 are referred to as "nestled" because of their mounting position relative to the position of gage inserts 80, in that one or more insert 70 is mounted in cone 14 between a pair of inserts 80 that are adjacent to one another in gage row 80*a*. Cone cutter 14 further includes a plurality of inner row cutter elements or inserts 81, 82, 83 secured to cone surface 46 and arranged in spaced-apart inner rows 81*a*, 82*a*, 83*a*, respectively. Relieved areas or lands 78 (best shown in FIG. 1) are formed about nestled gage inserts 70 to assist in mounting inserts 70. Heel inserts 60 generally function to scrape or ream the borehole sidewall 5 to maintain the borehole at full gage, to prevent erosion and abrasion of heel surface 44, and to protect the shirttail portion 19*a* of bit leg 19. Inserts 81, 82 and 83 of inner rows 81*a*, 82*a*, 83*a* are employed primarily to gouge or crush and remove formation material from the borehole bottom 7. Inner rows 81*a*, 82*a*, 83*a* of cone cutter 14 are arranged and spaced on cone cutter 14 so as not to interfere with the inner rows on each of the other cone cutters 15, 16.

Inserts 60, 70, 80 each include a base portion and a cutting portion. The base portion of each insert 60, 70, 80 is disposed within a mating socket drilled into the cone steel of a rolling cone cutter 14-16. Each insert 60, 70, 80 may be secured within the mating socket by any suitable means including without limitation an interference fit, brazing, or combinations thereof. The cutting portion of an insert extends from the base portion of the insert and includes a cutting surface for cutting formation material. The present disclosure will be understood with reference to one such cone cutter 14, cone cutters 15, 16 being similarly, although not necessarily identically, configured.

Figure 3:
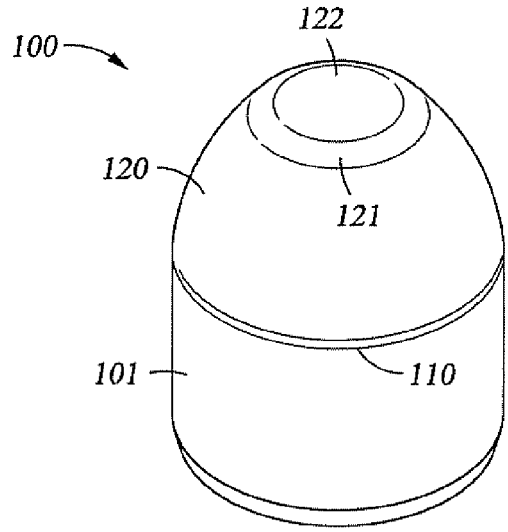
FIG. 3 is a perspective view of an insert suitable for use in the drill bit of FIG. 1.
Figure 3A:
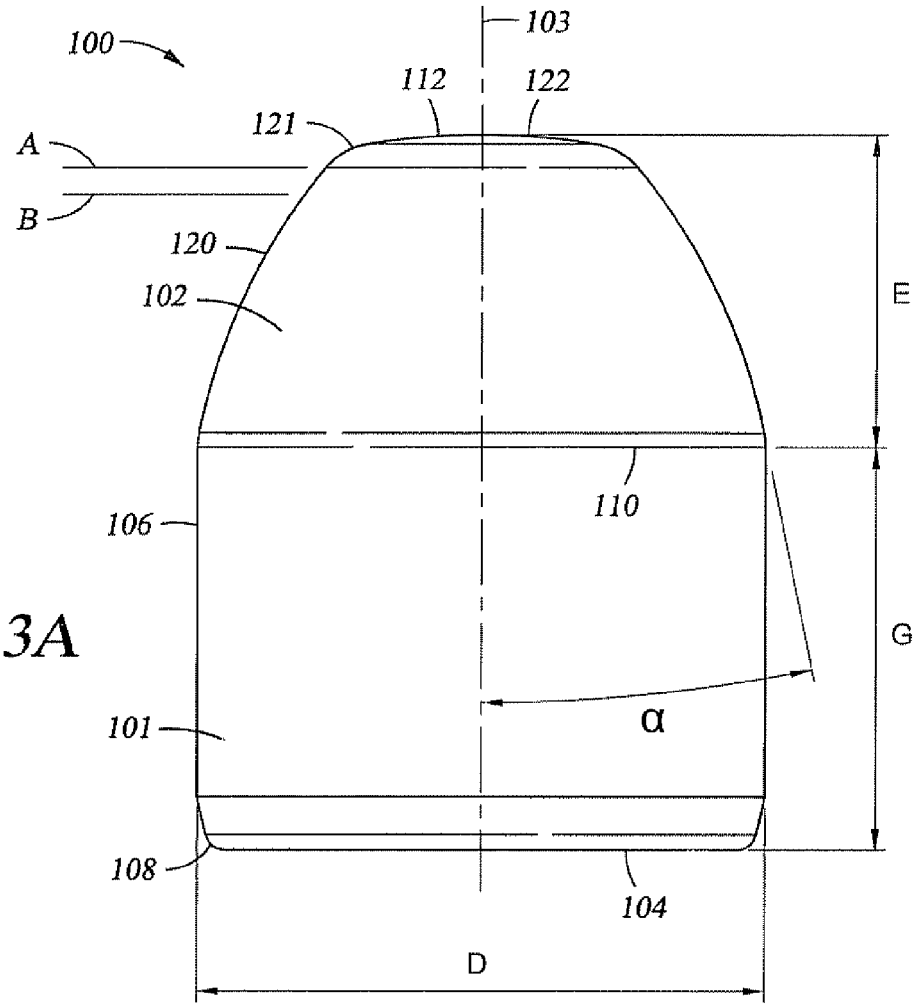
FIG. 3A is a side elevation view of the insert shown in FIG. 3.

Insert 100, suitable as an inner row or gage row cutter element, is shown in FIGS. 3 and 3A. Insert 100 is made of tungsten carbide or other hard materials through conventional manufacturing procedures. Insert 100 includes a generally cylindrical base portion 101 and a cutting portion 102 extending therefrom. Cutting portion 102 intersects base portion 101 at a plane of intersection 110.

Base portion 101 is the portion of insert 100 disposed within the mating socket provided in the cone steel of a cone cutter. Thus, as used herein, the term "base portion" refers to the portion of a cutter element or insert (e.g., insert 100) disposed within mating socket provided in the cone steel of a cone cutter (e.g., cone cutter 14). Further, as used herein, the term "cutting portion" refers to the portion of a cutter element or insert extending from the base portion. It should be understood that since the cutting portion extends from the base portion, and the base portion is disposed within the cone steel of a rolling cone cutter, the cutting portion represents the portion of the insert extending from the cone steel of the rolling cone cutter.

Insert 100 also includes a cutter element axis 103. In this embodiment, both base portion 101 and cutting portion 102 are symmetrical about any plane containing axis 103. Although cutting portion 102 and base portion 101 have a common axis 103 as shown in FIG. 3A, in different embodiments (not illustrated), base portion 101 may have a base axis (not shown) and cutting portion 102 may have a cutting axis (not shown) different from the base axis. In such embodiments, the base axis and cutting axis may be parallel, but laterally offset from one another. Alternatively, the base axis and cutting axis may not be parallel and instead be oriented at some acute angle relative to one another. For example, cutting portion 102 may be tilted to the side such that a portion of cutting portion 102 extends laterally beyond the side surface of base portion 101.

Referring now to FIG. 3A, base portion 101 includes a bottom surface 104 and a substantially cylindrical side surface 106 extending therefrom. The cylindrical side surface 106 and the bottom surface 104 intersect at a chamfered corner 108 so as to facilitate insertion and mounting of insert 100 into the receiving aperture formed in the cone steel. Base portion 101 and insert 100 as a whole include a diameter D as shown. Although base portion 101 shown in FIGS. 3 and 3A is generally cylindrical having a circular cross-section, base portion 101 may likewise be non-cylindrical and/or have a non-circular cross-section (e.g., cross-section of the base portion 101 may be oval, rectangular, asymmetric, etc.).

Insert 100 is retained in the cone steel up to the plane of intersection 110, with the cutting portion 102 extending beyond the cone steel by an extension height E. Thus, as used herein, the term "extension," "extension height," or "extension height E" refers to the axial length of the extension of a cutting portion beyond the cone steel. Further, at least a portion of the surface of base portion 101 is coupled to the cone steel of the mating socket within which base portion 101 is disposed. Thus, as used herein, the term "grip," "grip length," or "grip G" refers to the axial length of the base portion of an insert that is coupled to the cone steel.

As shown in FIG. 3A, cutting portion 102 extends from plane of intersection 110 to a cutting tip 112. Cutting portion 102 includes a generally conical geometry and thus has a tapered cutting profile. The cutting profile includes a side portion 120, a tip portion 122, and an intermediate portion 121 extending between side portion 120 and tip portion 122.

In the embodiment illustrated in FIG. 3A, cylindrical side surface 106 extends from bottom surface 104 to plane of intersection 110. In this particular embodiment, plane of intersection 110 substantially corresponds to the intersection of cylindrical side surface 106 and generally tapered side portion 120 of insert 100. In different embodiments, plane of intersection 110 may be located above or below the location where cylindrical side surface 106 intersects side portion 120, the location depending on the location of the surface of the cone steel within which base portion 101 is disposed. For instance, if insert 100 is mounted in a relatively deep mating socket in the cone steel of a cone cutter and only a portion of the generally tapered side portion 120 extends from the cone steel, then plane of intersection 110 will pass through side portion 120 above the location where cylindrical side surface 106 meets side portion 120. In another example, if insert 100 is mounted in a relatively shallow mating socket in the cone steel of a cone cutter and a portion of cylindrical side surface 106 extends beyond the cone steel, then plane of intersection 110 will pass through cylindrical side surface 106 below the location where cylindrical side surface 106 intersects side portion 120.

Figure 3B:
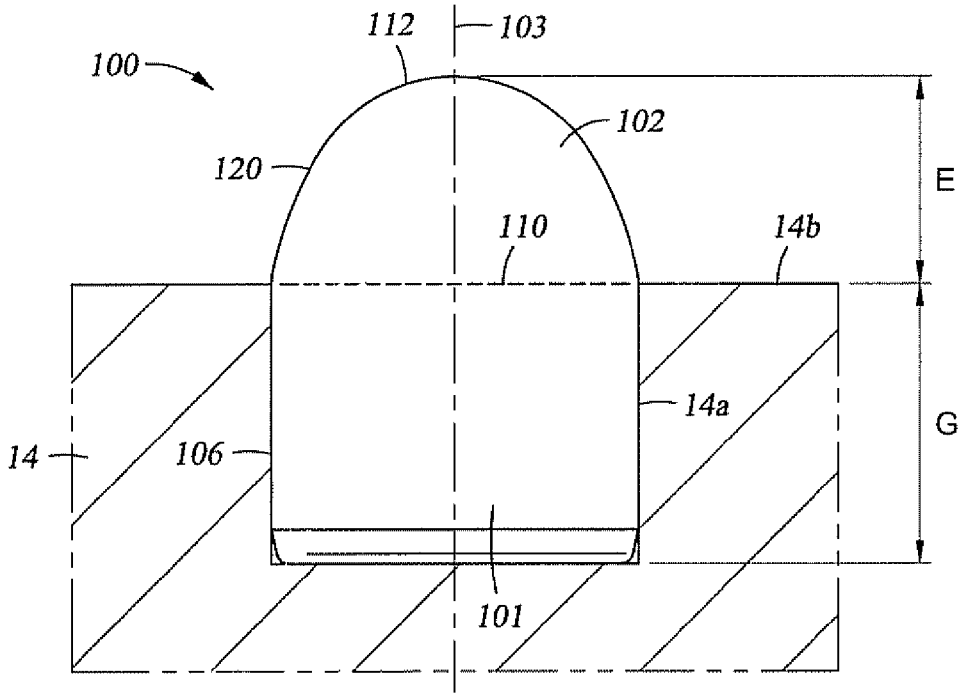
FIG. 3B is a partial sectional view of the insert shown in FIG. 3 mounted in a rolling cone cutter.

For a better understanding of the terms "base portion," "cutting portion," "grip G," and "extension height E," reference will be made to FIGS. 3B-3E which schematically illustrate several exemplary embodiments of insert 100 mounted in the cone steel of exemplary cone cutter 14. Referring to FIG. 3B, insert 100 is disposed in a mating socket 14*a* provided in the cone steel of an exemplary cone cutter 14. As previously defined, base portion 101 is the portion of insert 100 disposed in the cone steel of cone cutter 14, and cutting portion 102 extends from base portion 101. Base portion 101 and cutting portion 102 intersect at plane of intersection 110, which substantially corresponds with surface 14*b* of cone cutter 14 immediately about insert 100. Thus, base portion 101 is the portion of insert 100 below plane of intersection 110 and cutting portion 102 is the portion of insert 100 above plane of intersection 110. In this embodiment, plane of intersection 110 substantially corresponds to the intersection of cylindrical side surface 106 and generally tapered side portion 120 of insert 100. The entire surface of base portion 101 is coupled to the cone steel, hence grip G is the entire axial length of base portion 101. Further, in this embodiment, the entire side surface 106 is coupled to the cone steel. Extension height E represents the axial length of the extension of insert 100 and cutting portion 102 above surface 14*b*.

Figure 3C:
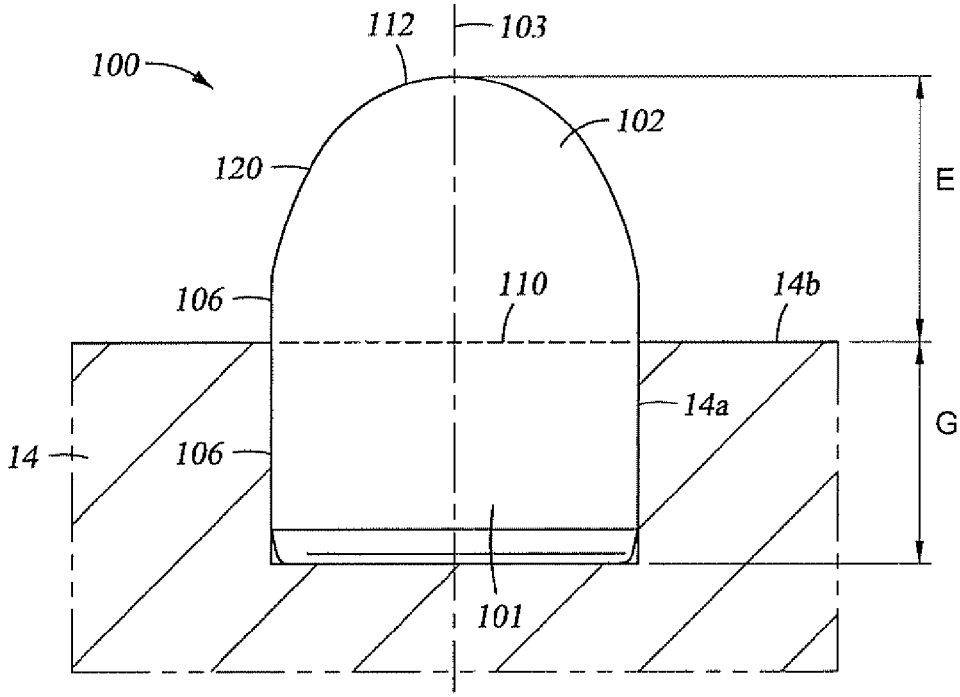
FIG. 3C is a partial sectional view of the insert shown in FIG. 3 mounted in a rolling cone cutter.

Referring to FIG. 3C, insert 100 is disposed in mating socket 14*a* provided in the cone steel, however, in this embodiment plane of intersection 110 does not correspond to the intersection of cylindrical side surface 106 and tapered side portion 120. Rather, plane of intersection 110 is below the intersection of side surface 106 and side portion 120. Plane of intersection 110 passes through side surface 106, and thus cutting portion 102 includes a portion of side surface 106 and base portion 101 includes a portion of side surface 106. Further, in this embodiment, the entire surface of base portion 101 is coupled to the cone steel, defining grip G. However, only a portion of side surface 106 is coupled to the cone steel. The portion of side surface 106 extending above plane of intersection 110 is not coupled to the cone steel. As previously defined, extension height E represents the axial length of the extension of cutting portion 102 above surface 14*b*.

Figure 3D:
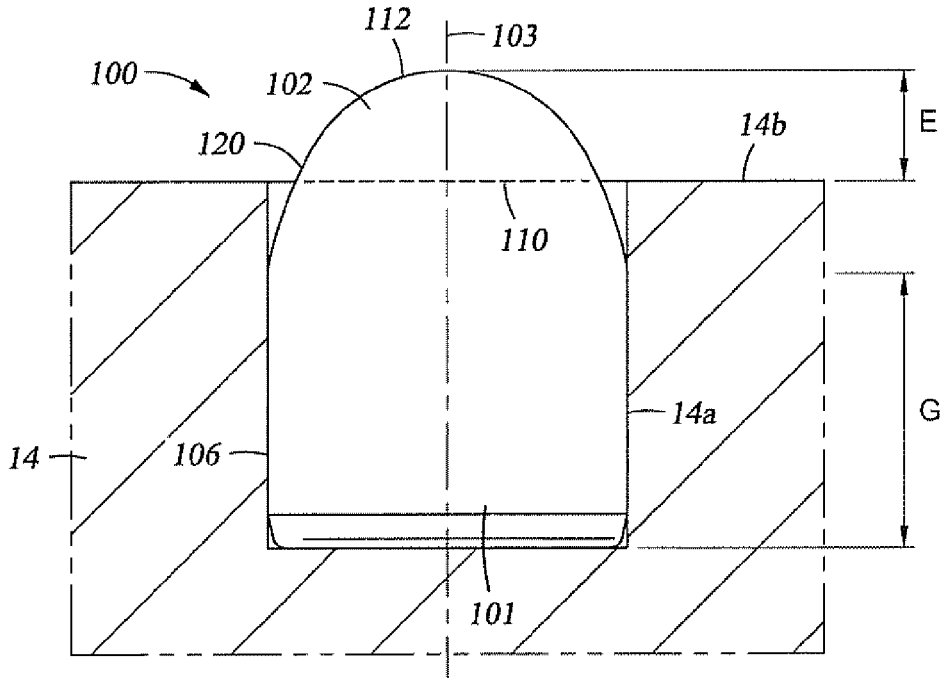
FIG. 3D is a partial sectional view of the insert shown in FIG. 3 mounted in a rolling cone cutter.

Referring to FIG. 3D, insert 100 is disposed in mating socket 14*a* provided in the cone steel. In this embodiment plane of intersection 110 does not correspond to the intersection of cylindrical side surface 106 and tapered side portion 120. Rather, plane of intersection 110 is above the intersection of side surface 106 and tapered side portion 120. In this embodiment, plane of intersection 110 passes through tapered side portion 120, and thus cutting portion 102 includes a portion of tapered side portion 120 and base portion 101 includes a portion of tapered side portion 120. Further, in this embodiment, only a portion of base portion 101 is coupled to the cone steel. In particular, all of side surface 106 is coupled to the cone steel, however, the portion of tapered side portion 120 within base portion 101 is not coupled to the cone steel. Thus, grip G is not the entire axial length of base portion 101. Extension height E represents the axial length of the extension of cutting portion 102 above surface 14*b*.

Referring still to FIG. 3D, in other embodiments, insert 100 may be completely disposed within a mating socket provided in the cone steel such that cutting tip 112 is flush with, or recessed below, the surface of the cone steel prior to use of the bit. For instance a drill bit may be designed with one or more super hard cutter element(s) or insert(s) (e.g., insert 100) flush with, or completely recessed below, the surface of the cone steel. In such a bit design, it may be contemplated that during use the cone steel around the one or more super hard insert(s) will wear at a greater rate than the insert(s), eventually resulting one or more insert(s) having a cutting portion (and extension height) extending from the cone steel in accordance with the embodiments described herein.

Figure 3E:
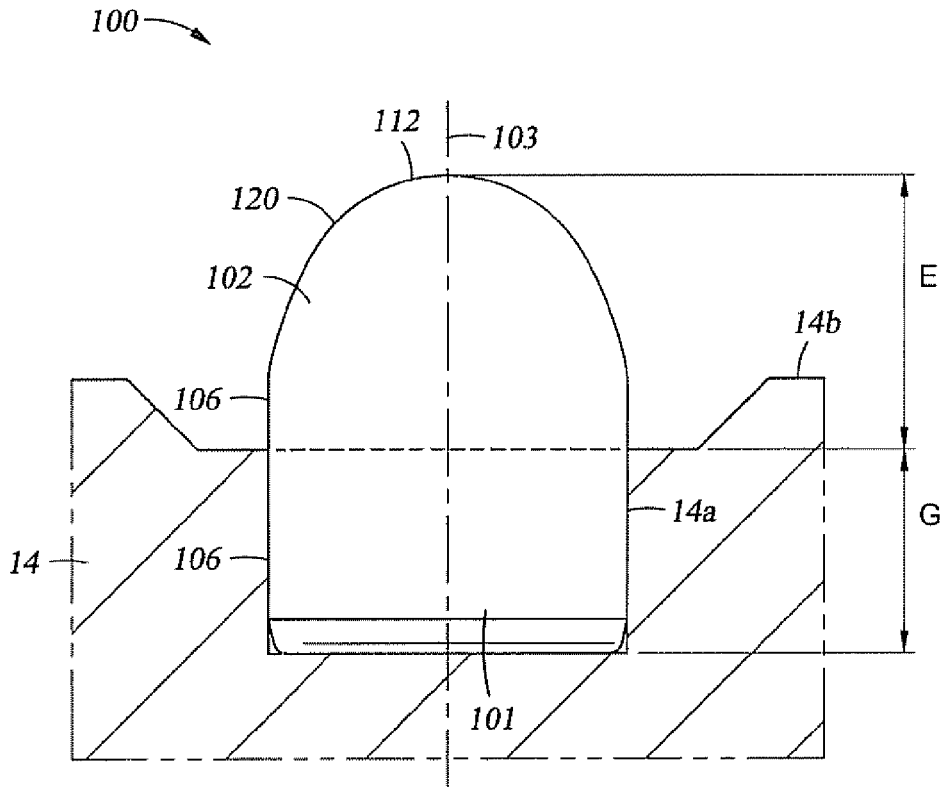
FIG. 3E is a partial sectional view of the insert shown in FIG. 3 mounted in a rolling cone cutter.

Referring to FIG. 3E, insert 100 is disposed in mating socket 14*a* provided in the cone steel. In this embodiment, plane of intersection 110 does not correspond to the intersection of cylindrical side surface 106 and tapered side portion 120. Similar to FIG. 3C, plane of intersection 110 is below the intersection of side surface 106 and side portion 120. Plane of intersection 110 passes through side surface 106, and thus cutting portion 102 includes a portion of side surface 106 and base portion 101 includes a portion of side surface 106. Further, in this embodiment, the entire surface of base portion 101 is coupled to the cone steel, defining grip G. However, only a portion of side surface 106 is coupled to the cone steel, the portion of side surface 106 above plane of intersection 110 is not coupled to the cone steel. As previously defined, extension height E represents the axial length of the extension of cutting portion 102 above surface 14*b*.

As best shown in FIG. 3A, tip portion 122 is relatively blunt compared to many conventional inner row inserts which include much sharper or more pointed cutting tips. In this embodiment, it is preferred that portions 120, 121 and 122 each have convex or outwardly bowed surfaces (surfaces having a positive radius of curvature). In the embodiment shown, and merely as a specific example, for an insert having a diameter D of approximately 0.5 inches, the radius of side portion 120 and tip portion 122 are each approximately 0.6 inches, with the blend radius of the intermediate portion 121 being approximately 0.06 inches. A tangent to side portion 120 taken where the side portion 120 intersects the cylindrical side surface 106 of base 101 forms an angle of approximately 11° as shown by angle $\alpha$ on FIG. 3A. In this specific example, the extension height E is approximately 0.3 inches, such that the ratio of extension height E-to-diameter D is 0.6. It is preferred that insert 100 have a ratio of extension height E-to-diameter D not greater than 0.75 and, more preferably, not greater than 0.65.

As previously mentioned, certain conventional inner row inserts are substantially longer and sharper than the insert 100 shown in FIGS. 3 and 3A. However, while insert 100 is tapered from a relatively wide base to a more narrow cutting tip 112, a substantial volume of insert material is nevertheless provided near cutting tip 112 so as to provide a robust and durable cutting element (e.g., insert 100) with a reduced wear rate during drilling, yet still shaped to provide desirable gouging or crushing and penetration of the borehole bottom as a result of the relatively blunt tip geometry described herein. It has been found on bits with certain, differently shaped prior art cutter elements, ROP actually increases as the cutter elements wears when drilling hard or abrasive formations. However, the useful life of such bits was limited due the high wear rate.

To achieve the desired durability and cutting action, it is preferred that cutting portion 102 include side surfaces that taper away from cylindrical side surface 106 and inwardly toward cutting tip 112 but, at the same time, that cutting portion 102 include a relatively large cross-sectional area near cutting tip 112. For example, the embodiment of insert 100 shown in FIG. 3A has a cross-sectional area perpendicular to insert axis 103 (e.g., taken at plane A) at a distance of 94% of the extension height E that is at least 20% of the cross-sectional area perpendicular to insert axis 103 taken through any portion of base portion 101 having a constant cross-sectional area (e.g., taken through any portion of base portion 101 having a diameter D). In the specific embodiment shown in FIG. 3A, it is preferred that the ratio of the cross-sectional area perpendicular to the insert axis 103 at 94% of extension height E to the cross-sectional area perpendicular to the insert axis 103 of any portion of base portion 101 having a constant cross-sectional area (e.g., taken through any portion of base portion 101 having a constant diameter D) is at least 0.20 and, more preferably, at least 0.22. In particular drilling applications where the rock is very abrasive and cutter element wear rate could be high, the ratio is preferably at least 0.25 In another example, and still referring to FIG. 3A, insert 100 has a cross-sectional area perpendicular to the insert axis 103 (e.g., taken at plane B) at a distance of 75% of the extension height E that is at least 44% of the cross-sectional area perpendicular to the insert axis 103 of any portion of base portion 101 having a constant cross-sectional area (e.g., taken through any portion of base portion 101 having a constant diameter D). In the specific embodiment shown in FIG. 3A, it is preferred that the ratio of the cross-sectional area perpendicular to the insert axis 103 at 75% extension height to the cross-sectional area perpendicular to the insert axis 103 of any portion of base portion 101 having a constant cross-sectional area (e.g., taken through any portion of base portion 101 having a constant diameter D) be at least 0.44 and, more preferably, at least 0.46. In particular drilling applications where the rock is very abrasive and cutter wear rate could be high, the ratio is preferably at least 0.50.

Figure 4:
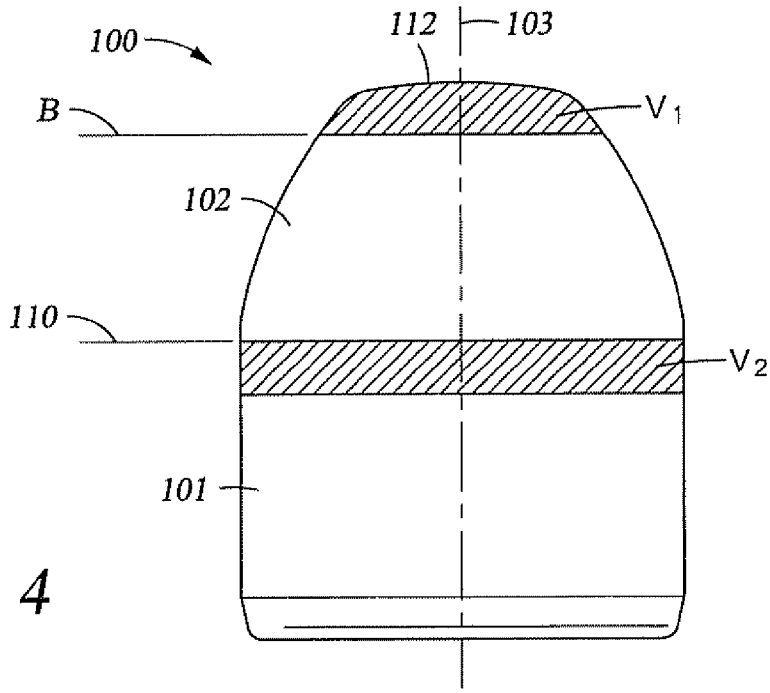
FIG. 4 is a side elevation view of the insert shown in FIG. 3A showing, schematically, the relationship of particular volumes of insert material at different locations along the insert axis.

The relatively blunt cutting surface 104 of insert 100 may also be described with reference to a volume of insert material in a segment of cutting portion 102 taken near cutting tip 112 as compared to a volume of insert material in a segment of base portion 101. More particularly, it is desired that the ratio of the volume of a 0.03 inch axial length of cutting portion 102 at cutting tip 112 to the volume of a 0.03 inch axial length of base portion 101 having a constant cross-sectional area fall within a particular range. Still more particularly, and as best shown in FIG. 4, it is preferred that the ratio of the volume of insert material in region $V_1$ (the volume of a 0.03 inch axial segment of cutting portion 102 measured from cutting tip 112), referred to herein as the "tip volume," to the volume in region $V_2$ (the volume of a 0.03 inch axial length of constant cross-section area of base portion 101), referred to herein as the "base volume," is at least 0.17 for drill bits being classified by IADC nomenclature as Series 5-0-x or harder bits. As used herein, the term "tip-to-base volume ratio" refers to the ratio comparing the volume of insert material in a 0.03 inch axial length measured from cutting tip to the volume of any 0.03 inch axial length of constant cross-section area of a base portion. Another preferred tip-to-base volume ratio is at least 0.18.

As those skilled in the art understand, the International Association of Drilling Contractors (IADC) has established a classification system for identifying bits that are suited for particular formations. Bits are usually specified in terms of an IADC nomenclature number which indicates the hardness and strength of the formation in which they are designed to be employed. The bit's IADC numeric nomenclature consists of a series of three numerals that are outlined within the "BITS" section of the current edition of the International Association of Drilling Contractors (IADC) Drilling Manual. The first numeral designates the bit's "series," of which the numerals 1-3 are reserved for Milled Tooth Bits in the soft, medium and hard formations, and the numerals 4-8 are reserved for insert bits in the soft, medium, hard and extremely hard formations. The second numeral designates the bit's "type" within the series. The third numeral relates to the mounting arrangement of the roller cones and is generally not directly related to formation hardness or strength and consequently represented by an "x" when IADC codes are referred to herein. A higher "series" numeral indicates that the bit is capable of drilling in a harder formation than a bit with a lower series number. A higher "type" number indicates that the bit is capable of drilling in a harder formation than a bit of the same series with a lower type number. For example, a "5-2-x" IADC insert bit is capable of drilling in a harder formation than a "4-2-x" IADC insert bit. A "5-3-x" IADC insert bit is capable of drilling in harder formations than a "5-2-x" IADC insert bit. The IADC numeral classification system is subject to modification as approved by the International Association of Drilling Contractors to improve bit selection and usage. As used in herein, the phrase "IADC classification of at least Series 5" shall mean and include all IADC classifications of 5-0-x and harder.

It is also useful to describe the relatively blunt nature of cutting surface 104 of insert 100 with respect to the tip volume, or the volume of insert material in a 0.03 inch segment of insert 100 measured from cutting tip 112. In this regard for insert bits having the IADC classification 5-0-x and harder (including up to, for example, 8-0-x), the embodiment described above may have a tip volume of at least 0.0010 $in^3$, and preferably has a tip volume greater than 0.0011 $in^3$. The blunt nature of insert 100 can also be described by comparing the tip volume to the extension height E-to-diameter D ratio. The embodiment described above may have a tip volume of at least 0.0010 $in^3$, and preferably has a tip volume greater than 0.0011 $in^3$ for an insert (e.g., insert 100) having an extension height E-to-diameter D ratio not greater than 0.75

Without limiting the application of the insert 100 described above, it is believed that insert 100 is particularly well-suited for drilling in formation material having an unconfined compressive strength of between about 20-55 kpsi, or having a ratio of shear strength to compressive strength greater than about 1.1. In particular, the insert 100 described above is believed particularly suited for drilling in granites, sandstones, siltstones and conglomerates having unconfined compressive strength greater than about 20 kpsi and, more particularly, in formations encountered within the region generally known as the Unayzah field and Harweel Cluster.

Although portions 120, 121 and 122 of insert 100 have been shown and described as convex, one or more of these surfaces may be planar, concave or frustoconical. For example, tip portion 122 may be planar or slightly concave. Likewise, rather than having a positive radius, side portion 120 may be frustoconical such that, in a profile view as in FIG. 3A, the taper of side portions 120 would appear as a straight line. Likewise, intermediate portion 121 may be frustoconical. While the bowed or convex shape is presently preferred for portions 120, 121, and 122, the concave, planar, or frustoconical surfaces may instead be employed where the insert is constructed to have one or more of the geometric characteristics or ratios described above.

In comparison to the sharper conical or chisel shaped inserts typically employed in hard rock formations, insert 100 is relatively blunt. In other words, cutting tip 112 of insert 100 is broader and not as sharp as such conventional inner row cutter elements employed in hard rock formations. Providing a relatively blunt cutting surface and cutting tip on an inner row cutter element or insert for hard rock formation is counterintuitive given that it has been generally believed that a sharp cutting surface and cutting tip is necessary to penetrate hard formations such as granite and other materials having a high compressive strength. Despite its unconventional geometry for the application, the blunt tipped cutting element 100 has been shown to provide desirable ROP, durability, and reduced wear rate in hard rock formations.

Figure 5:
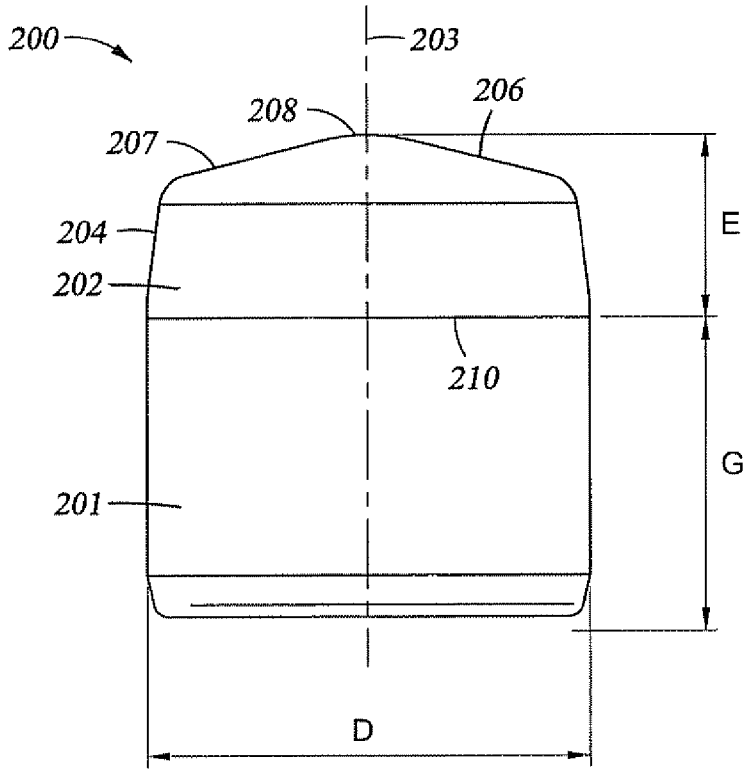
FIG. 5 is a side elevation view of another insert suitable for use in the drill bit of FIG. 1.
Figure 6:
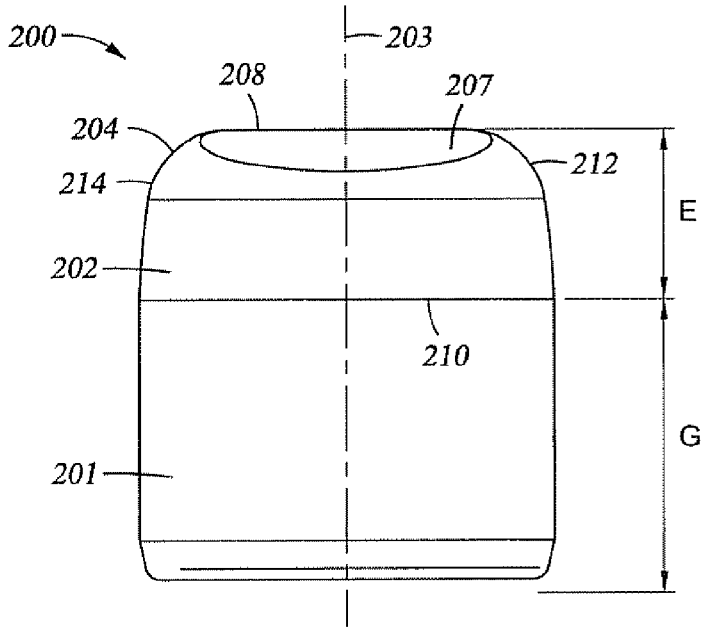
FIG. 6 is a front elevation view of the insert of FIG. 5.

Referring now to FIGS. 5 and 6, another cutter element or insert 200 is shown that has particular utility in an inner row of a cone cutter, such as inner rows 81*a*, 82*a*, 83*a* of FIG. 1. Insert 200 includes a base portion 201 substantially the same as base portion 101 previously described with reference to FIG. 3. In addition, insert 200 includes an insert axis 203, a cutting portion 202 having a cutting surface 204 which includes converging flanks 206, 207 that meet in a linear crest or ridge 208. Flanks 206, 207 are generally planar surfaces formed in cutting portion 202 which, along with crest 208, generally define a chisel-shaped cutting surface 204. Cutting portion 202 is symmetrical about a plane containing crest 208 and insert axis 203. As shown in FIG. 5, flanks 206, 207 intersect at crest 208 with the peak of crest 208 being radiused or rounded so as to eliminate undesirable stress concentrations at the cutting tip. As best shown in FIG. 6, cutting surface 204 further includes convex side surfaces 212, 214 which extend from each end of crest 208 to a plane of intersection 210. Alternatively, flanks 206, 207 may form a relatively sharp crest at their line of intersection; however, such an embodiment would create regions of high stress and may cause the insert to be more susceptible to breakage or chipping. Still further, flanked portions 206, 207 of the cutting portion may terminate in a generally flat crest or ridge 220, as shown in profile in FIG. 7.

Figure 7:
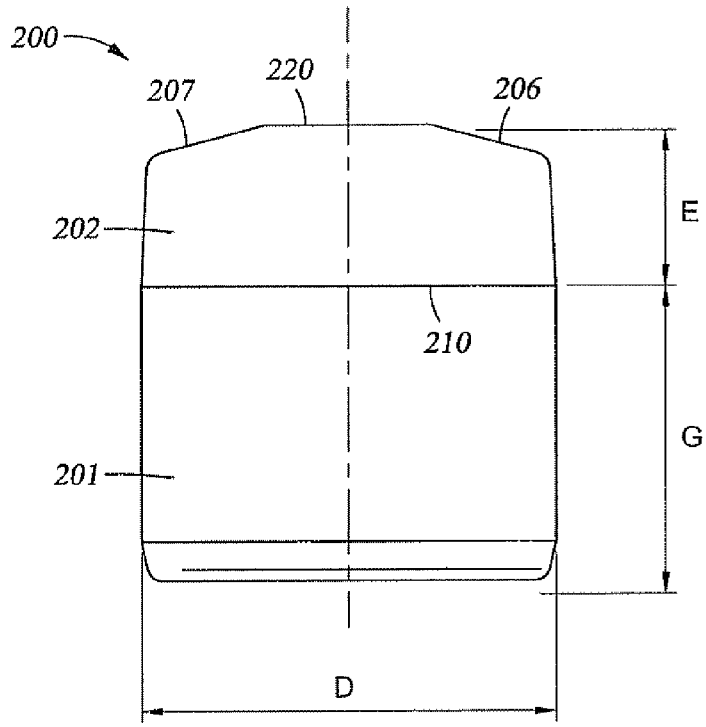
FIG. 7 is a side elevation view, similar to FIG. 5, of another insert suitable for use in the drill bit of FIG. 1.
Figure 8:
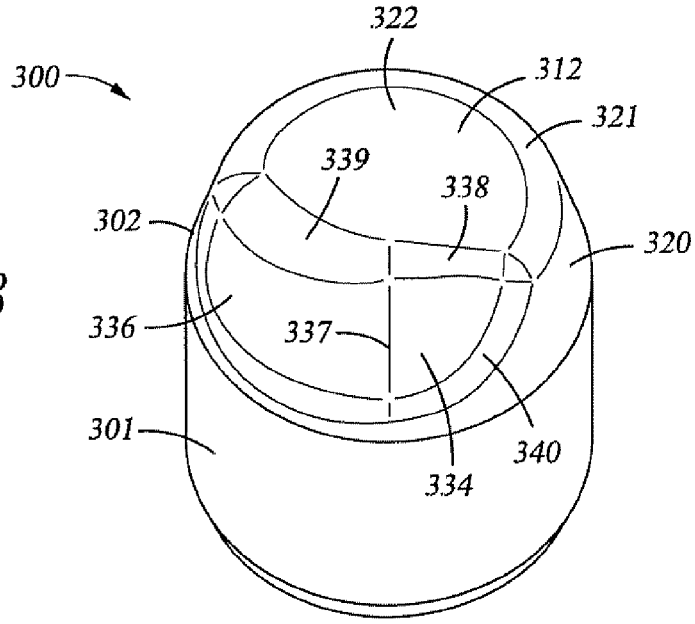
FIG. 8 is a perspective view of another insert suitable for use in the drill bit of FIG. 1 and having particular application in a gage row.

In each embodiment of insert 200 shown in FIGS. 5-7, cutting portion 202 is preferably designed and manufactured such that the ratio of extension height E-to-diameter D is not greater than 0.75, and more preferably not greater than 0.65. Likewise, it is desirable that cutting surface 204, although chisel-shaped and generally sharper than cutting surface 104 of insert 100 shown in FIG. 3, still have a substantial volume of insert material near the cutting tip. More specifically, it is preferred that the ratio of the cross-sectional area perpendicular to axis 203 taken at a distance of 94% of the extension height E to the cross-sectional area perpendicular to axis 203 taken through any portion of base portion 201 having a constant cross-sectional area (e.g., taken through any portion of base portion 201 having a constant diameter D) is at least 0.20, and more preferably at least 0.22 for each embodiment of insert 200 shown in FIGS. 5-7. In particular drilling applications where the rock is very abrasive and cutter wear rate could be high, the ratio is at least 0.25. Also, it is preferred that the ratio of the cross-sectional area perpendicular to axis 203 at a distance of 75% of the extension height E to the cross-sectional area perpendicular to axis 203 taken through any portion base portion 201 having a constant cross-sectional area (e.g., taken through any portion of base portion 201 having a constant diameter D) is at least 0.44, and, more preferably, at least 0.46 for each embodiment of insert 200 shown in FIGS. 5-7. In particular drilling applications where the rock is very abrasive and cutter wear rate could be high, the ratio is preferably at least 0.50.

Likewise, it is desired that each embodiment of insert 200 shown in FIGS. 5-7 has a tip-to-base volume ratios, as defined above, of at least 0.17 for drill bits classified by IADC nomenclature as series 5-0-x or harder bits, and preferably greater than 0.18 Further, it is desired that each embodiment of insert 200 shown in FIGS. 5-7 have a tip volume of at least 0.0010 $in^3$, and preferably at least 0.0011 $in^3$, for insert bits having the IADC classification 5-0-X and harder. Still further, the embodiments of insert 200 described above can have a tip volume of at least 0.0010 $in^3$, and preferably have a tip volume greater than 0.0011 $in^3$ for a cutting element with an extension height E-to-diameter D ratio not greater than 0.75.

Figure 13:
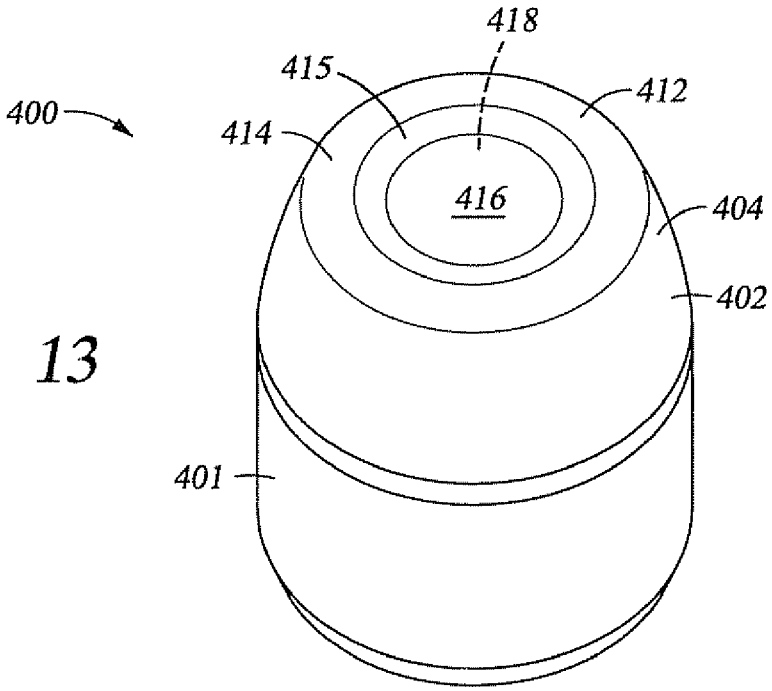
FIG. 13 is a perspective view of another insert suitable for use in the drill bit of FIG. 1.
Figure 14:
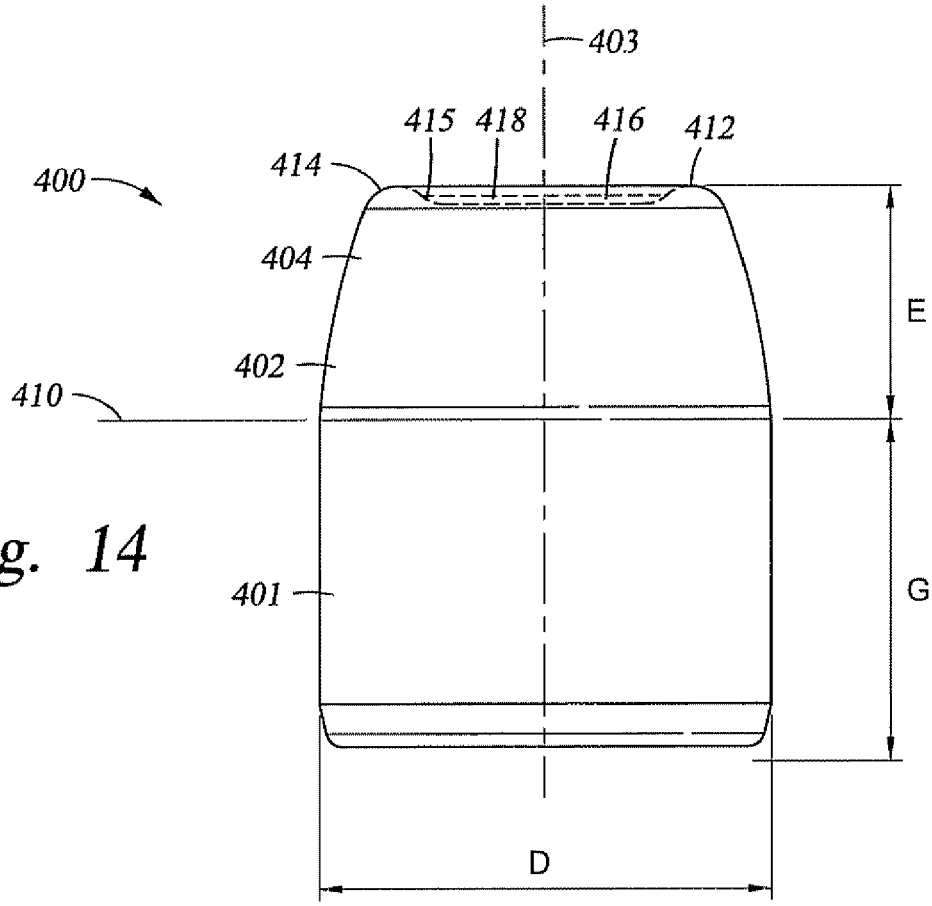
FIG. 14 is a side elevation view of the insert shown in FIG. 13.

Referring now to FIGS. 13 and 14, another cutter element or insert 400 is shown having particular utility in an inner row of a cone cutter, such as in inner rows 81*a*, 82*a*, 83*a* shown in FIG. 1. Insert 400 includes a base portion 401 substantially the same as base 101 previously described with reference to FIG. 3. Insert 400 also includes a cutting portion 402 extending from base 401 and having a cutting surface 404 symmetrically disposed about a longitudinal insert axis 403. A plane of intersection 410 generally divides insert 400 into base portion 401, having grip length G that is retained in the cone steel of a rolling cone cutter, and cutting portion 402 extending to an extension height E. Cutting surface 404 includes a generally conical geometry extending from base portion 401 to cutting tip 412. In this embodiment, cutting surface 404 includes outwardly bowed sides along its entire profile. Although insert 400 has been shown having cutting surface 404 with outwardly bowed sides, cutting surface 404 may likewise be frustoconical and have substantially straight sides when viewed in profile.

Cutting tip 412 includes an annular ridge or a lip 414 which encircles a generally circular-shaped planar surface 416. Cutting tip 412 further includes an annular sloping region 415 extending between the top of lip 414 and central planar surface 416. Given this geometry, cutting tip 412 includes a hollow region or void 418, and thus insert 400 may be described as a hollow point cutter element. It is preferred that the surfaces forming cutting surface 404 be continuously contoured to minimize undesirable stress concentrations. Lip 414, in conjunction with void 418, provides the potential for easier penetration into the formation (less penetration force required) as compared to a typical conical or even blunt chisel insert geometry which has limited surface area to penetrate and break the rock. At the same time, collectively, lip 414, annular sloping region 415 and planar surface 416 present a substantial surface area to gouge or crush the rock, potentially yielding a larger crater and increased overall ROP.

For use in hard and/or abrasive formations, it is preferred that insert 400 be constructed so as to have the extension height-to-diameter ratios, the tip-to-base volume ratios, the tip volumes and the ratios of cross-sectional areas (at 94% extension height and 75% extension height) as set out above in describing insert 200. In softer formations, a cutter element having the hollow region or void 418 in its cutting tip 412 may be employed without regard to the above-described geometric ratios.

Certain of the features and geometries previously described with reference to FIGS. 3-7, which provide an effective but relatively blunt cutter element intended primarily for relatively hard and/or abrasive formations, may also be applied to cutter elements intended for use in the gage row of a rolling cone cutter. As previously described, the gage row performs both side wall and bottom hole cutting duty and helps define and maintain the full gage diameter of the borehole. Because the gage cutter element performs both cutting duties, and because the demands of these separate duties differ, it is desirable to provide some relief to the cutting portion that cuts the borehole wall.

More specifically, and referring now to FIGS. 8-11, a cutter element or insert 300 is designed and constructed for use in the gage row 80*a* (FIG. 1), and includes features so as to reduce the tensile stresses applied to the insert due to contact with the borehole sidewall as the cutting portion engages and then moves out of engagement with the formation material. Insert 300 includes a cylindrical base 301 as previously described and a cutting portion 302 extending therefrom and having a cutting surface 304 that is asymmetrical. Cutting surface 304 includes a cutting tip portion or region 322 that may be described as having an inner end 330 and an outer end 332. Cutting surface 304 further includes a side portion 320 having a convex shape and an intermediate portion 321 extending between side portion 320 and tip portion 322. Side portion 320, tip portion 322, and intermediate portion 321 preferably include a positive radius. For example, tip portion 322 may include a radius of one inch and side portion 320 may have a radius of two inches for an insert 300 having a diameter D of approximately 0.5 inch. The radius of intermediate portion 321 is chosen to blend the radii of tip portion 322 and side portion 320 to eliminate sharp edges.

Figure 9:
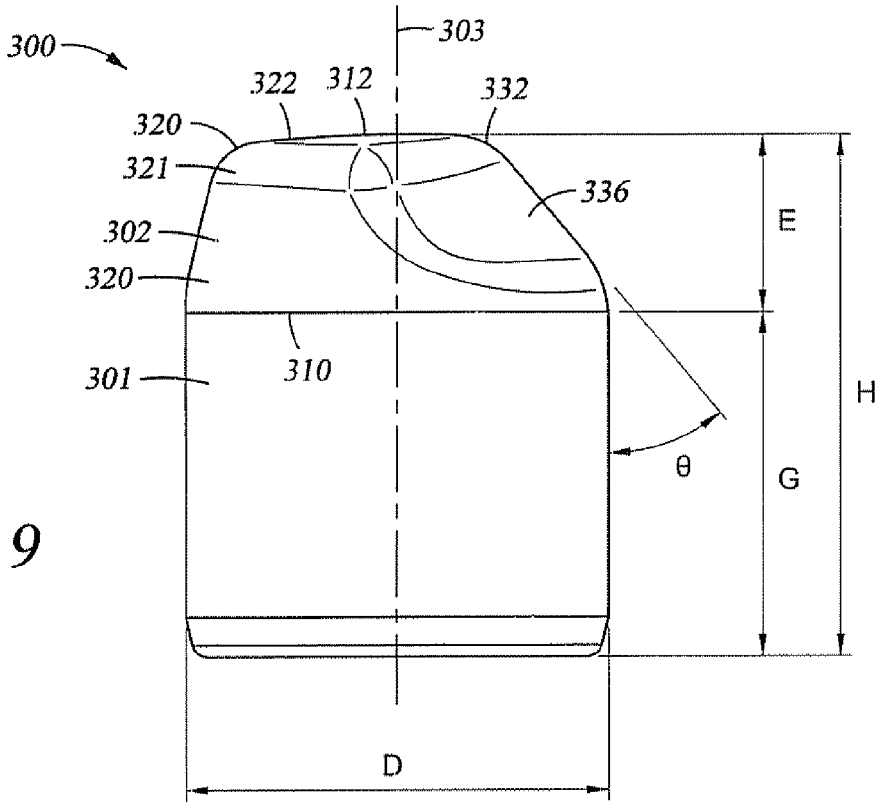
FIG. 9 is a side elevation view of the insert shown in FIG. 8.

Cutting surface 304 also includes a wear face 334, trailing face 336, and leading and trailing transition surfaces 338, 339, respectively. Transition surfaces 338 and 339 are radiused, and blend the radius of tip portion 322 into wear face 334 and trailing face 336, respectively. Wear face 334 and trailing face 336 are contiguous and generally intersect at radiused intersection 337. Wear face 334 intersects side portion 320 in an arcuate cutting edge 340. Edge 340 is sharp relative to intersection 337, transition surfaces 338, 339, and relative to the other intersections that wear face 334 and trailing face 336 make with side portion 320. As best shown in the profile of FIG. 9, wear face 334 extends towards the cutter element axis 303 at an angle that may be defined as a gage angle Θ that, in this example, is approximately 38°.

As used herein to describe a portion of a cutter element's cutting surface, the term "sharper" indicates that either (1) the angle defined by the intersection of two lines or planes or (2) the radius of curvature of a curved surface, is smaller than a comparable measurement on a portion of the cutting surface to which it is compared, or a combination of features (1) and (2). Eliminating abrupt changes in curvature or small radii between adjacent regions on the cutting surface lessens undesirable areas of high stress concentrations which can cause or contribute to premature cutter element breakage. It is preferred that the leading transition 338 be sharper than trailing transition surface 339 so as to optimize cutting efficiency of the borehole sidewall. However, depending upon the formation being drilled, the leading transition 338 may also be contoured or radiused more so as to make the intersection more dull to improve the durability. As used herein, the terms "contoured" or "sculpted" refer to cutting surfaces that can be described as continuously curved surfaces wherein relatively small radii (less than 0.080 inches) are used to break sharp edges or round off transitions between adjacent distinct surfaces as is typical with many conventionally-designed cutter elements. Although FIGS. 8-11 depict faces that include substantially planar portions, all of the faces on the cutting surface can be rounded so as to be convex, concave, or have various other non-planar configurations.

Figure 10:
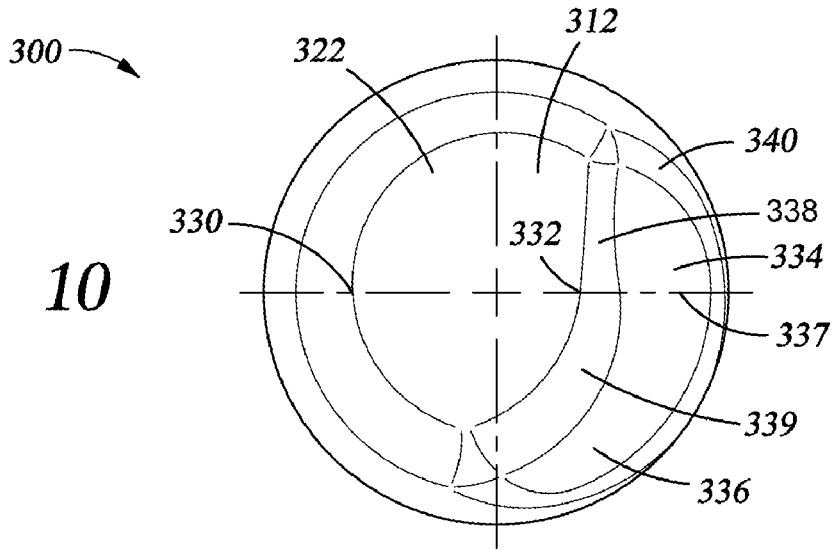
FIG. 10 is a top view of the insert shown in FIG. 8.
Figure 11:
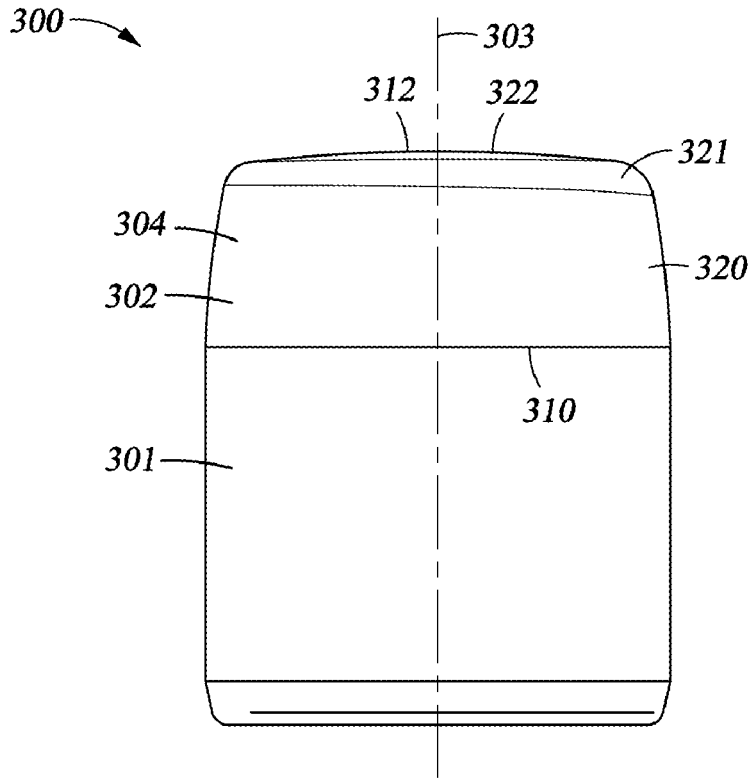
FIG. 11 is a front elevation view of the insert shown in FIG. 8.

Referring to the top view of FIG. 10, wear face 334 has a smaller radius of curvature than trailing surface 336 as measured perpendicular to axis 303. In addition to increasing the radius of the cutting surface as measured moving from the wear face 334 to trailing face 336, the trailing face 336 may also be canted away from the borehole sidewall. Certain of these principles are described in more detail in assignee's U.S. Pat. No. 6,059,054, each of which is incorporated herein by reference in its entirety.

Figure 12:
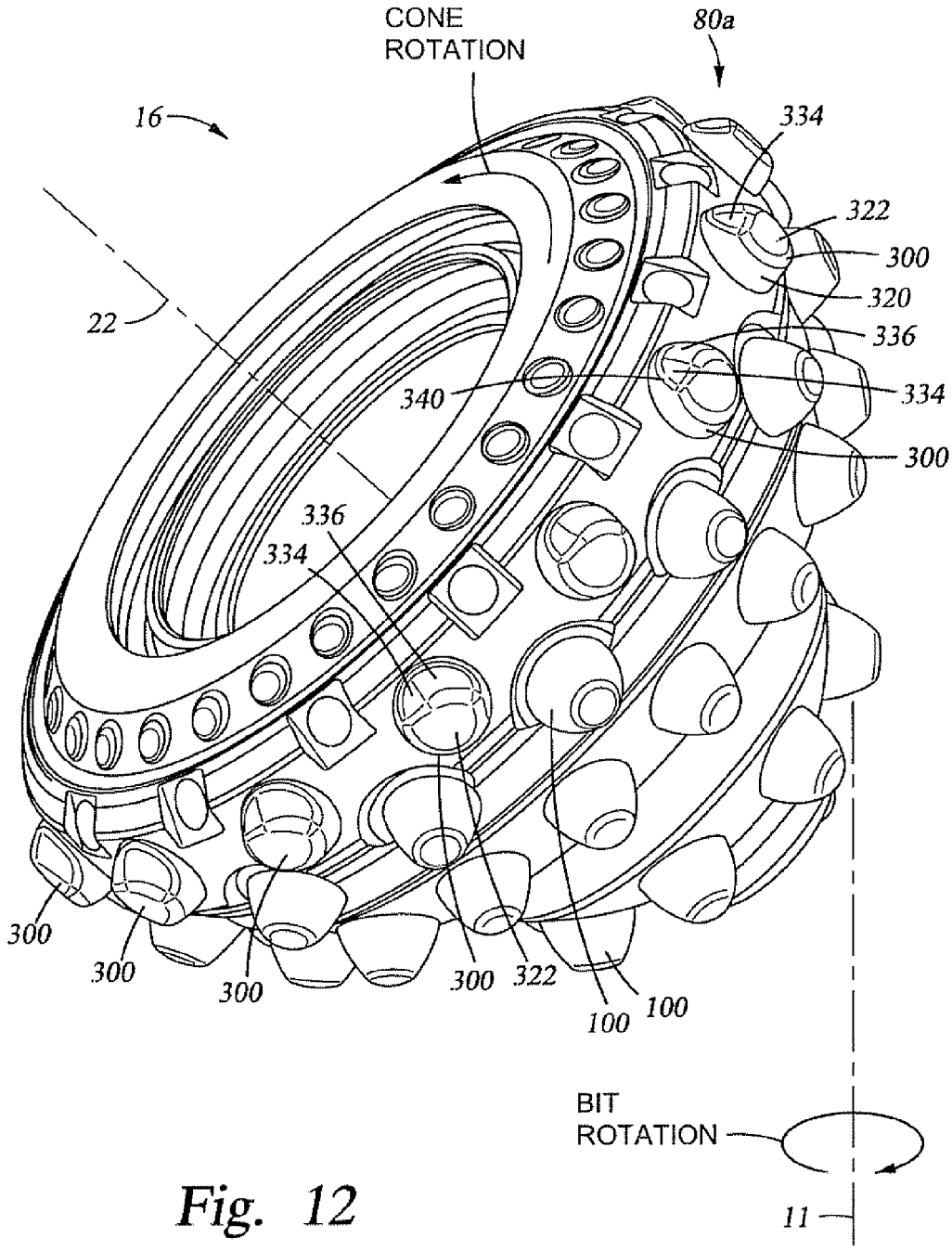
FIG. 12 is a perspective view of one cone cutter of the rolling cone bit shown in FIG. 1 as viewed along the bit axis from the pin end of the bit.

An enlarged view of cone cutter 16 is shown in FIG. 12. As shown, cone cutter 16 includes a gage row 80*a* having a plurality of inserts 300 as previously described. The inserts 300 are disposed in gage row 80*a* such that wear face 334 faces the borehole side wall and trailing face 336 generally slopes away from the borehole sidewall. Insert 300 is positioned in row 80*a* such that trailing surface 336 is closer to bit axis 11 than wear face 334. In this position, the trailing portion of cutting surface 304 is less likely to fail due to the detrimental tensile stresses imposed on the cutter element.

In the embodiments illustrated in FIGS. 8-12, tip portion 312 is intended for bottom hole cutting and, even with its relatively blunt geometry, it is intended to penetrate even hard and abrasive formations. Wear face 334 engages the borehole sidewall and provides scraping and reaming. Trailing face 336 is relieved away from the borehole sidewall. Wear face 334 provides a relatively sharp edge 340 at its intersection with side portion 320 to promote shearing of the sidewall.

Figure 15:
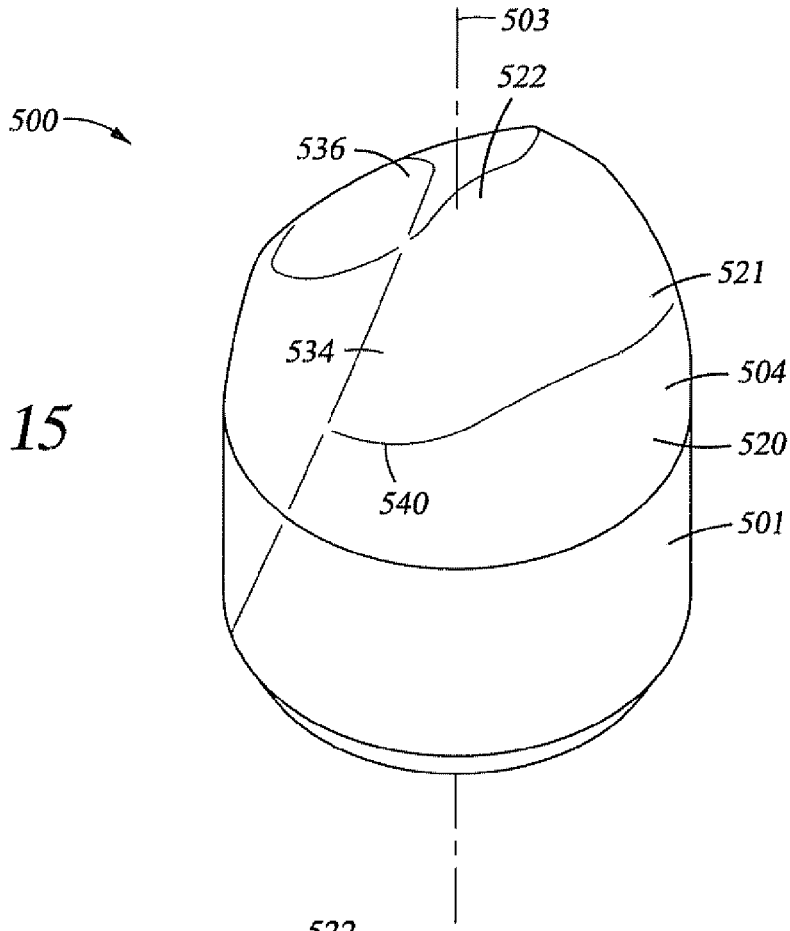
FIG. 15 is a perspective view of another insert suitable for use in the drill bit of FIG. 1 and having particular application in a gage row.
Figure 16:
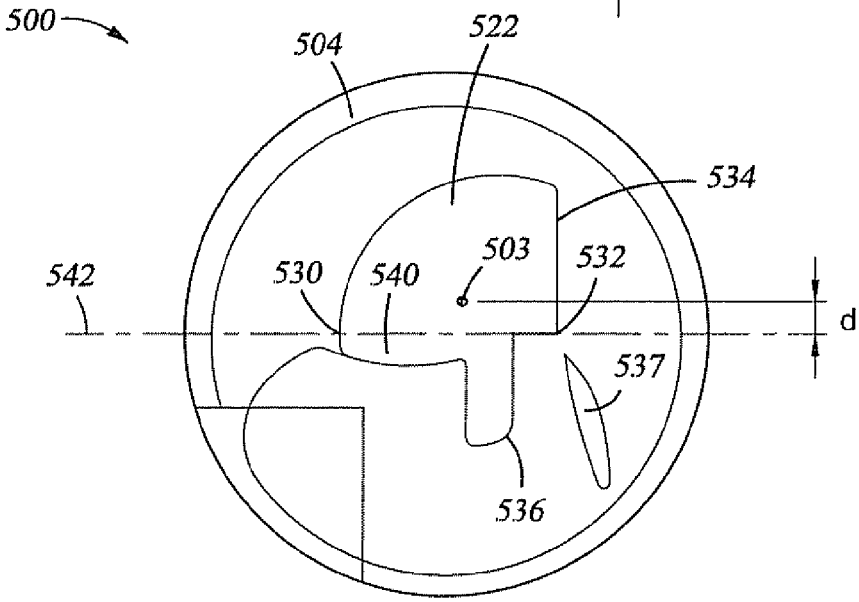
FIG. 16 is a top view of the insert shown in FIG. 15.

Referring now to FIGS. 15 and 16, another cutter element or insert 500 is disclosed which includes features and geometry making it particularly suited for use in a gage row 80*a* (FIG. 1). Insert 500 includes a base portion 501 and a cutting portion 502 extending therefrom. In many respects, insert 500 is similar to insert 300 previously disclosed, insert 500 differing from insert 300 in the configuration of its cutting surface 504. Cutting surface 504 includes side portion 520, intermediate portion 521, and a cutting tip portion 522 that includes an inner end 530 and an outer end 532. As best shown in FIG. 15, intermediate portion 521 extends between side portion 520 and tip portion 522. Preferably, side portion 520, tip portion 522 and intermediate portion 521 all include a positive radius. Cutting surface 504 also includes wear face 534 and a trailing face 536 which are contiguous and both generally planar and intersect at radiused intersection 537. Wear face 534 intersects side portion 320 in an arcuate cutting edge 540 that is sharp relative to the other intersections between tip portion 522, wear face 534, trailing face 536, and side portion 520. The intersection of trailing face 536 and tip portion 522 forms a generally linear margin 540 which may be said to define a margin axis 542.

When placed in a cone cutter, such as cone cutter 16 shown in FIG. 12, insert 500 is oriented with wear face 534 facing the borehole sidewall and with trailing face 536 generally sloping away from the borehole sidewall. Margin axis 542 extends generally linearly and, in this embodiment, is offset a distance "d" from the insert axis 503, it being understood that, in other embodiments, trailing face 536 and cutting tip 522 may be arranged such that margin axis 542 passes through axis 503.

As with the inserts previously described with reference to FIGS. 3-7, it is desirable that inserts 300 and 500 have a relatively blunt cutting portion, yet still have a tapered cutting surface to penetrate the borehole bottom. Accordingly, inserts 300 and 500 are preferably designed and constructed so as to have a ratio of extension height E-to-diameter D of not greater than 0.65, and more preferably, not greater than 0.5. As a specific example, insert 300 may have an extension of 0.22 inches and a diameter of 0.5 inches.

It is also desired that inserts 300 and 500 include a substantial volume of insert material near cutting tip portion 322, 522, respectively. Accordingly, inserts 300 and 500 preferably have a ratio of cross-sectional area perpendicular to axis 303, 503 taken at a distance of 94% of the extension height E to the cross-sectional area perpendicular to axis 303, 503 taken through any portion cylindrical base portion 301, 501 having a constant cross-sectional area (e.g., taken through any portion of base portion 301, 501 having constant diameter D) of at least 0.30, and, more preferably, is at least 0.35. Still further, inserts 300 and 500 preferably have a ratio of cross-sectional area perpendicular to axis 303, 503 taken at 75% of extension height E to cross-sectional area perpendicular to axis 303, 503 taken through any portion of cylindrical base portion having a constant cross-sectional area (e.g., taken through any portion of base portion 301, 501 having constant diameter D) of at least 0.50.

Comparing 0.03 inch axial lengths, it is desired that the tip-to-base volume ratio of inserts 300 and 500 be at least 0.20 for drill bits being classified by IADC nomenclature as Series 5-0-x or harder bits, and more preferably, at least than 0.22. Further, for the insert bits having the IADC classification 5-0-X and harder, it is preferred that inserts 300 and 500 include a tip volume greater than 0.0010 $in^3$, and preferably greater than 0.0015 $in^3$. In particular, for an insert 300 (or 500) having a tip volume not less than 0.0010 $in^3$, the insert preferably has an extension height E-to-diameter D ratio not greater than 0.65 and a tip volume greater than 0.0015 $in^3$.

Figure 17:
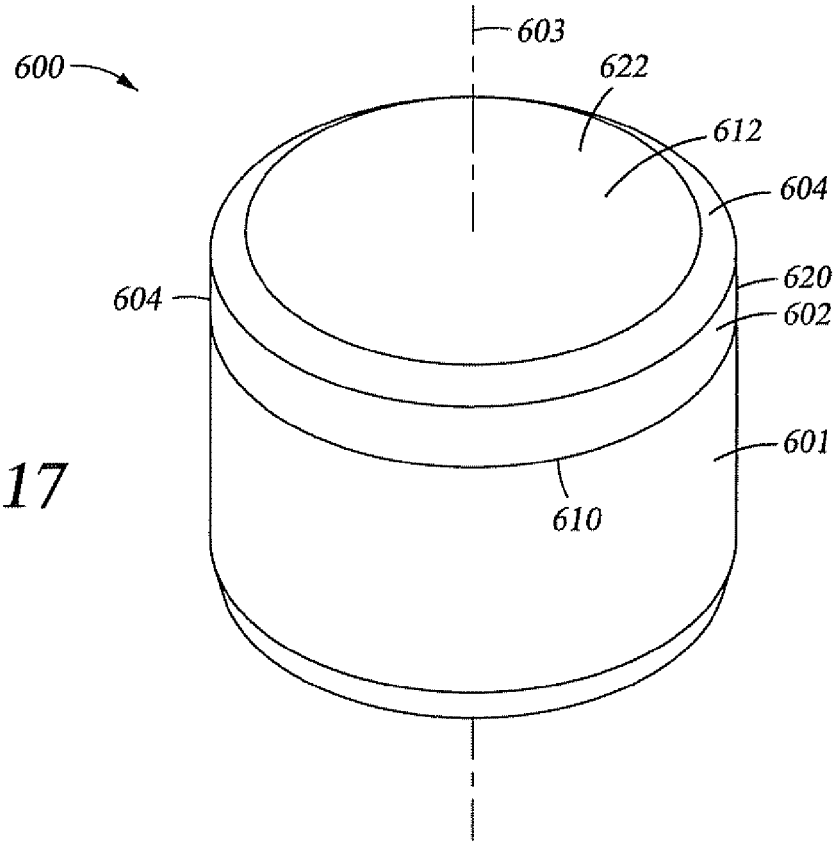
FIG. 17 is a perspective view of another insert suitable for use in the drill bit of FIG. 1 and having application in a gage row, and/or inner row.
Figure 18:
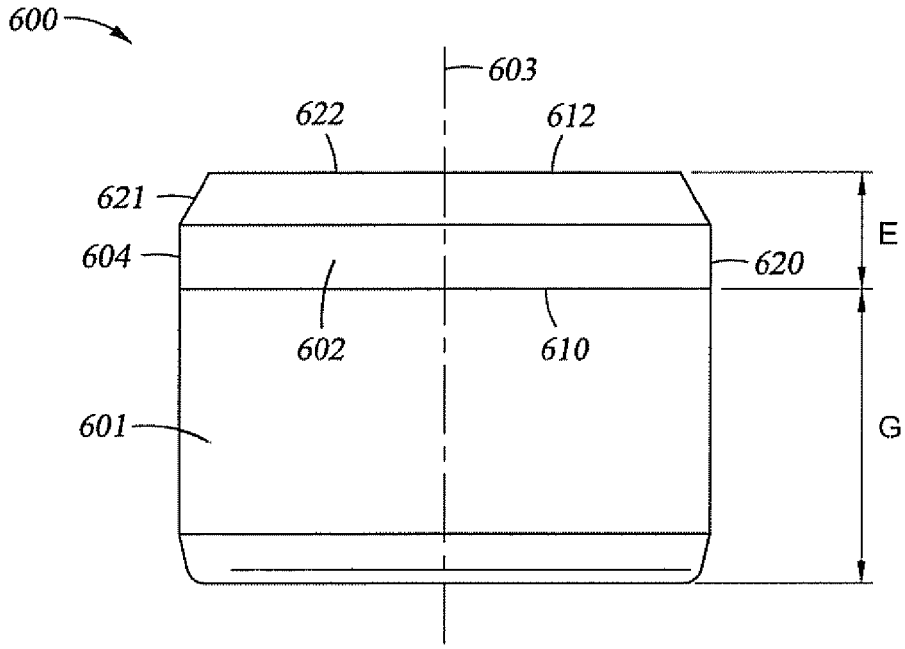
FIG. 18 is a side elevation view of the insert shown in FIG. 17.

Referring now to FIGS. 17 and 18, another cutter element or insert 600 suitable as an inner row or gage row cutter element is shown. Insert 600 includes a base portion 601 substantially the same as base 101 previously described with reference to FIG. 3. Insert 600 includes a cutting portion 602 extending from base portion 601 and having a cutting surface 604 symmetrically disposed about longitudinal axis 603. A plane of intersection 610 generally divides insert 600 into base portion 601, having grip length G that is retained in the cone cutter, and cutting portion 602 extending to an extension height E. Cutting surface 604 has a generally cylindrical geometry extending from base portion 601 to a cutting tip 612. The cutting profile of cutting surface 604 includes a generally cylindrical side surface 620 extending from base portion 601 to cutting portion 602, a substantially planar tip surface 622 substantially perpendicular to axis 603, and an intermediate surface 621 extending between side surface 620 and tip surface 622. In the embodiment shown in FIGS. 17 and 18, cylindrical side surface 620 is oriented substantially perpendicular to tip surface 622, however, intermediate surface 621 provides a chamfered corner between side surface 620 and tip surface 622.

Although insert 600 has been shown as having a cutting surface 604 with a generally cylindrical side surface 620, cutting surface 604 may likewise have a frustoconical, outwardly bowed (convex), inwardly bowed (concave), or tapered side surface. Further, although insert 600 has been shown as having a cutting surface 604 with a substantially planar or flat tip surface 622, cutting surface 604 may likewise have a convex, concave, arcuate, symmetric or asymmetric tip surface. Still further, although cutting surface 604 of insert 600 illustrated in FIGS. 17 and 18 includes a chamfered corner (e.g., intermediate surface 621) between tip surface 622 and side surface 620, in different embodiments, cutting surface 604 may have no chamfered corner, a continuously contoured surface, or tip surface 622 may extend laterally beyond side surface 620.

For use in hard and/or abrasive formations, it is preferred that insert 600 have a relatively blunt cutting portion 602. Accordingly, insert 600 is preferably designed and manufactured so as to have a ratio of extension height E-to-diameter D of not greater than 0.65, and more preferably, not greater than 0.5. Further, it is also desired that insert 600 include a substantial volume of insert material near cutting tip portion 622. Accordingly, insert 600 preferably has a ratio of cross-sectional area perpendicular to axis 603 taken at a distance of 94% of the extension height E to cross-sectional area perpendicular to axis 603 taken through any portion of cylindrical base portion 601 having a constant cross-sectional area (e.g., taken through any portion of base portion 601 having a constant diameter D) of at least 0.30, and, more preferably, is at least 0.50. Still further, insert 600 preferably has a ratio of cross-sectional area perpendicular to axis 603 taken at 75% of extension height E to cross-sectional area perpendicular to axis 603 taken through any portion of cylindrical base portion 601 having a constant cross-sectional area (e.g., taken through any portion of base portion 601 having a constant diameter D) of at least 0.50. In some extremely blunt embodiments of insert 600 (e.g., insert 600 has relatively little or no tapered side portions), one or both of the ratios of cross-sectional areas (at 94% extension height and 75% extension height) may be greater than 0.75.

Comparing 0.03 inch axial lengths, it is desired that the tip-to-base volume ratio of insert 600 be at least 0.20 for drill bits being classified by IADC nomenclature as Series 5-0-x or harder bits, and more preferably, at least than 0.22. In extremely blunt designs, the tip-to-base volume ratio maybe greater than 0.75. Further, for the insert bits having the IADC classification 5-0-X and harder, it is preferred that insert 600 include a tip volume greater than 0.0010 $in^3$, and preferably greater than 0.0015 $in^3$. In particular, for an insert 600 having a tip volume of at least 0.0010 $in^3$, insert 600 preferably has an extension height E-to-diameter D ratio not greater than 0.65 and a tip volume greater than 0.0015 $in^3$.

Figure 19:
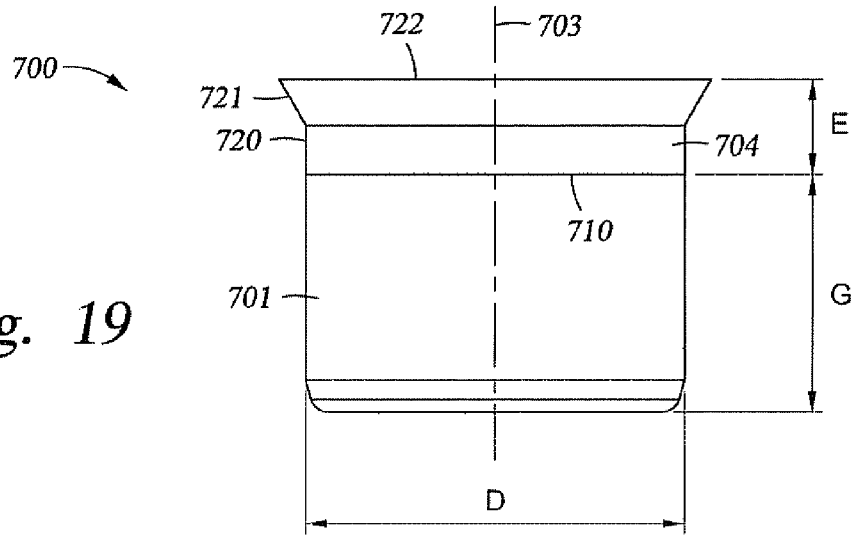
FIG. 19 is a side elevation view, similar to FIG. 18, of another insert suitable for use in the drill bit of FIG. 1 and having application in a gage row, and/or inner row.

Referring now to FIG. 19, another cutter element or insert 700 suitable as an inner row or gage row cutter element is shown. Insert 700 includes a base portion 701 substantially the same as base 101 previously described with reference to FIG. 3. Insert 700 includes a cutting portion 702 extending from base portion 701 and having a cutting surface 704 symmetrically disposed about longitudinal axis 703. A plane of intersection 710 generally divides insert 700 into base portion 701, having grip length G that is retained in the cone cutter, and cutting portion 702 extending to a cutting tip 712 and having an extension height E. The cutting profile of cutting surface 604 includes a generally cylindrical side surface 720, a substantially planar tip surface 722 substantially perpendicular to axis 703, and an intermediate surface 721 extending between side surface 720 and tip surface 722. In this embodiment, tip surface 722 extends laterally beyond side surface 720.

For use in hard and/or abrasive formations, it is preferred that insert 700 be designed and manufactured to have the extension height E-to-diameter D ratios, the tip-to-base volume ratios, the tip volumes and the ratios of cross-sectional areas (at 94% extension height and 75% extension height) as set out above in describing insert 600. It should be understood that since insert 700 includes tip surface 722 extends laterally beyond side surface 720, in some embodiments, the tip-to-base volume ratio of insert 700 may be greater than 1.0. Similarly, in some embodiments, the ratios of cross-sectional areas (at 94% extension height and/or 75% extension height) may be greater than 1.0.In softer formations, a cutter element or insert having a flat cutting tip surface 722 may be employed without regard to the above-described geometric ratios.

In the embodiments illustrated in FIGS. 17-19, the substantially planar cutting tip surface 622, 722 may be employed for bottom hole cutting, and/or cutting the corner of the borehole. Even with its relatively blunt geometry, inserts 600, 700 are intended to penetrate even harder and abrasive formations.

Figure 20:
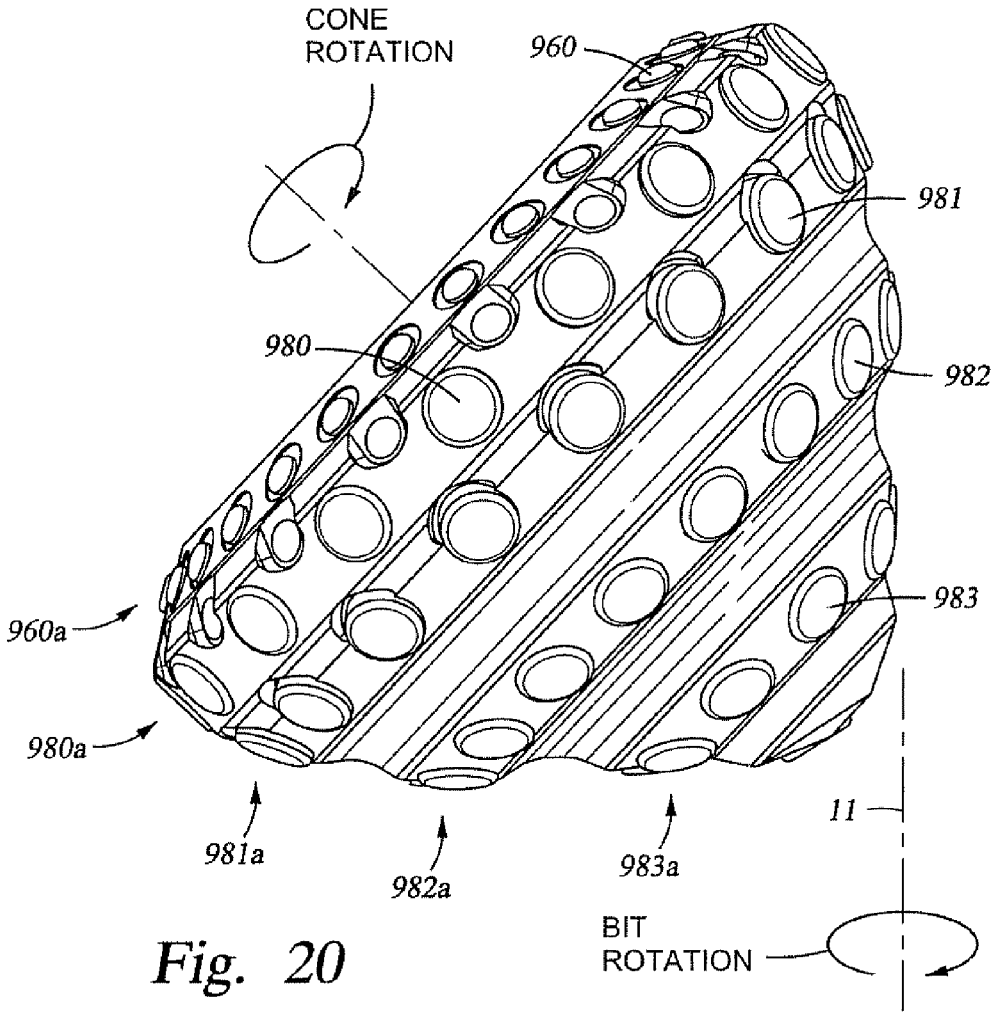
FIG. 20 is a perspective view of another cone cutter suitable for use in the rolling cone bit shown in FIG. 1.

FIG. 20 illustrates an enlarged view of a cone cutter 916 that may be used with bit 10 shown in FIG. 1. Cone cutter 916 includes a circumferential heel row 960*a* including a plurality of cutter elements or inserts 960, a gage row 980*a* including a plurality of inserts 980, and a plurality of inner rows 981*a*, 982*a*, 983*a* each including a plurality of inserts 981, 982, 983, respectively. The plurality of inner row inserts 981, 982, 983 are employed primarily to gouge or crush and remove formation material from the borehole bottom. In the embodiment illustrated in FIG. 20, gage row inserts 980, and inner row inserts 981, 982, 983 are substantially the same as insert 600 illustrated in FIGS. 17 and 18. In different embodiments, one or more of the gage row inserts 980, and inner row inserts 981, 982, 983 may be equivalent to insert 700 illustrated in FIG. 19.

In comparison to cone cutters typically employed in hard rock formations that include sharper conical or chisel shaped cutting inserts in the gage row and inner rows, the inserts of cone cutter 916 are relatively blunt and have a relatively small extension height. Providing a relatively blunt cutting surface and cutting tip on inserts included in cone cutter 916 for hard rock formation is counterintuitive given that it has been generally believed that a sharp cutting surface and cutting tip is desirable to penetrate hard formations such as granite and other materials having a high compressive strength. Despite the unconventional geometry of the inserts in cone cutter 916, cone cutter 916 is intended to provide desirable ROP, durability, and reduced wear rate in hard rock formations. In addition, by employing inserts with a relatively small extension height, the amount of intermesh of cutter elements or inserts on adjacent rolling cone cutters of the same bit is reduced. Reduction in the amount of intermesh enables the use of larger cone cutters, larger bearings, and greater flexibility in the placement of inserts. When cone cutter 916 is employed in harder rock formations, it is preferred that at least some of inserts 980, 981, 982, 983 comprise a diamond or other super hard or super abrasive material.

Like insert 100, previously described, inserts 200, 300, 400, 500, 600, and 700 have relatively dull or blunt cutting surfaces in comparison to conventional inserts used in inner rows and some gage rows for cutting hard formations. As previously stated, it was traditionally believed that a relatively sharp cutting tip was advantageous to penetrate and remove hard rock material. By contrast, and counter intuitively, the cutter elements or inserts 200, 300, 400 and 500 employ more rounded and blunt cutting tips, yet are intended to provide favorable penetration rates and durability.

It is to be understood that the blunt nature of each cutter element or insert described herein is not strictly characterized, and hence is not strictly defined, by the particular shape of the cutter element or insert. For instance, although cutter elements or inserts (e.g., insert 100, 200, 300, 400, 500, 600, and 700) have been described herein as having a cylindrical base portion (e.g., base portion 101) with a generally circular cross-section, however, in general, the base portions of cutter elements or inserts designed in accordance with the principles described herein may have any suitable geometry including without limitation cylindrical, oval, or rectangular. Rather, the preferred blunt nature of each cutter element or insert described herein is characterized by one or more factors including without limitation the extension height-to-diameter ratios, the tip-to-base volume ratios, the tip volumes and the ratios of cross-sectional areas (at 94% extension height and 75% extension height), or combinations thereof.

Additional wear-resistance may be provided to the cutting inserts described herein. In particular, portions or all of the cutting surfaces of inserts 100, 200, 300, 400, 500, 600, and 700 as examples, may be coated with diamond or other super-abrasive material in order to optimize (which may include compromising) cutting effectiveness and/or wear-resistance. Super abrasives are significantly harder than cemented tungsten carbide. As used herein, the term "super abrasive" means and includes polycrystalline diamond (PCD), cubic boron nitride (CBN), thermal stable diamond (TSP), polycrystalline cubic boron nitride (PCBN), and any other material having a material hardness of at least 2,700 Knoop (kg/mm2). As examples, PCD grades have a hardness range of about 5,000-8,000 Knoop (kg/mm2) while PCBN grades have hardnesses which fall within the general range of about 2,700-3,500 Knoop (kg/mm2). By way of comparison, conventional cemented tungsten carbide grades typically have a hardness of less than 1,500 Knoop (kg/mm2).

Certain methods of manufacturing cutting elements with PCD or PCBN coatings are well known. Examples of these methods are described, for example, in U.S. Pat. Nos. 5,766,394, 4,604,106, 4,629,373, 4,694,918 and 4,811,801, the disclosures of which are all incorporated herein by this reference.

While preferred embodiments of this invention have been shown and described, modifications thereof can be made by one skilled in the art without departing from the spirit or teaching herein. The embodiments described herein are exemplary only and are not limiting. Many variations and modifications of the system and apparatus are possible. Accordingly, the scope of protection is not limited to the embodiments described herein, but is only limited by the claims which follow, the scope of which shall include all equivalents of the subject matter of the claims.

What is claimed is:

1. A rolling cone drill bit for drilling a borehole in earthen formations, the bit comprising:

a bit body having a bit axis;

at least one rolling cone cutter mounted on the bit body for rotation about a cone axis and having a first surface for cutting the borehole bottom and a second surface for cutting the borehole sidewall;

a plurality of cutter elements secured to the cone cutter and extending from the first surface and positioned in a first circumferential row;

at least one of the cutter elements comprising a cutter element axis, a base portion having a diameter, and a cutting portion extending from the base portion to a point furthermost from the base portion defining an extension height;

wherein the ratio of the cross-sectional area of the cutter element defined by a plane perpendicular to the cutter element axis at a point equal to ninety-four percent of the extension height to the cross-sectional area of the cutter element base defined by a plane perpendicular to the cutter element axis is greater than 0.2; and wherein the ratio of the extension height to the base diameter is not greater than 0.75.

2. The drill bit of claim 1 wherein the ratio of extension height to base diameter is not greater than 0.65.

3. The drill bit of claim 1 wherein the cutter element is an inner, row cutter element having a generally conical cutting portion including a side portion, a tip portion, and an intermediate portion between the side portion and the tip portion, wherein each of the side, tip and intermediate portions are convex.

4. The drill bit of claim 3 wherein the tip portion has a radius of curvature that is greater than the diameter of the base portion.

5. The drill bit of claim 3 further comprising a circumferential row of gage cutter elements mounted in the cone cutter to cut the corner of the borehole, wherein at least one of the gage row cutter elements includes a ratio of extension height to base diameter of not greater than 0.5.

6. The drill bit of claim 1 wherein the first circumferential row is a gage row of cutter elements mounted in the cone cutter to cut the corner of the borehole, and wherein the cutter element has a ratio of extension height to base diameter that is not greater than 0.5.

7. The drill bit of claim 6 wherein the cutter element includes a wear face and a contiguous trailing face, and wherein the cutter element is mounted in the cone cutter such that the wear face is generally facing the borehole sidewall and the trailing face tapers away from the borehole sidewall.

8. The drill bit of claim 7 wherein the ratio of the cross-sectional area of the cutter element at a point equal to 94% of the extension height to the cross-sectional area of the cutter element base, is greater than 0.30.

9. The drill bit of claim 6 wherein the ratio of the cross-sectional area of the cutter element at a point equal to 75% of the extension height to the cross-sectional area of the cutter element base, is greater than 0.5.

10. The drill bit of claim 1 wherein the first circumferential row is an inner row of cutter elements mounted in the cone cutter to cut the borehole bottom, and wherein the at least one cutter element includes a cutting surface comprising a pair of flank regions that converge to define an elongate crest.

11. The drill bit of claim 1 wherein the at least one cutter element includes a tip-to-base volume ratio of at least 0.17, and wherein the bit has an IADC classification of at least Series 5.

12. The drill bit of claim 11 wherein the at least one cutter element has a tip volume of at least 0.0010 $in^3$.

13. The drill bit of claim 1 wherein the cutting portion is asymmetric relative to the cutter element axis.

14. The drill bit of claim 1 wherein at least a portion of the cutting portion extends radially beyond the base portion.

15. The drill bit of claim 1, wherein the at least one cutter element has a tip-to-base volume ratio of at least 0.30.

16. The drill bit of claim 15, wherein the at least one cutter element is mounted in the rolling cone cutter and secured in a position to cut against the borehole sidewall.

17. The drill bit of claim 15 wherein the tip-to-base volume ratio of the at least one cutter element is greater than 0.75.

18. The drill bit of claim 17 wherein the at least one cutter element comprises a substantially planar cutting surface at the extension height that is substantially perpendicular to the cutter element axis.

19. The drill bit of claim 15 wherein the base portion of the at least one cutter element has a non-circular cross-section.

20. A rolling cone drill bit for drilling through earthen formations to form a borehole with a hole bottom and a sidewall, the drill bit comprising:

at least one rolling cone cutter rotatably mounted on a bit body, the rolling cone cutter including a first surface generally facing the borehole bottom and a second surface generally facing the sidewall of the borehole;

at least one cutter element mounted in the rolling cone cutter and secured in a position to cut against the borehole bottom;

the at least one cutter element including a base portion and a cutting portion extending from the base portion to a cutting tip, the cutting portion tapering from the base portion to the cutting tip and defining an extension height;

wherein the at least one cutter element has a tip-to-base volume ratio of at least 0.17;

wherein the ratio of the cross-sectional area of the at least one cutter element at a point equal to 94% of the extension height to the cross-sectional area of the at least one cutter element base portion, is at least 0.22.

21. The drill bit of claim 20 wherein the bit has an IADC classification at least series 5.

22. The drill bit of claim 20 wherein the tip-to-base volume ratio of the at least one cutter element is at least 0.18.

23. The drill bit of claim 22, wherein the at least one cutter element comprises a tip volume of at least 0.0010 $in^3$.

24. The drill bit of claim 20 wherein the at least one cutter element has a generally conical cutting surface and includes a tip volume of at least 0.0010 $in^3$.

25. The drill bit of claim 20 further comprising:

a first circumferential row of inner row cutter elements;

a second circumferential row of gage row cutter elements;

wherein a plurality of the inner row cutter elements include cutting portions having a generally conical shape, and wherein a plurality of the gage row cutter elements include cutting portions having a ratio of an extension height to base diameter that is not greater than 0.5.

26. The drill bit of claim 25 wherein the plurality of inner row cutter elements each include a ratio of extension height to base diameter of not greater than 0.65.

27. The drill bit of claim 20 wherein the at least one cutter element is mounted in the cone cutter in an inner row of cutter elements and positioned to engage the borehole bottom, and wherein the at least one cutter element includes a cutting portion that is chisel-shaped.

28. The drill bit of claim 20 further comprising:

a first circumferential row of inner row cutter elements;

a second circumferential row of gage row cutter elements;

wherein at least one of the inner row cutter elements is positioned in the cone cutter to cut against the borehole bottom and includes a ratio of cross-sectional area at a point equal to 94% of the extension height to the cross-sectional area of its base that is equal to at least 0.22; and wherein at least one of the gage row cutter elements has a ratio of cross-sectional area at a point equal to 94% of the extension height to the cross-sectional area of its base that is equal to at least 0.30.

29. The drill bit of claim 28 wherein the at least one gage row cutter element includes a wear face and is oriented in the cone cutter such that the wear face generally faces the borehole sidewall.

30. The drill bit of claim 20 wherein the tip-to-base volume ratio of the at least one cutter element is at least 0.30.

31. The drill bit of claim 30 wherein the at least one cutter element comprises a cutter element axis, wherein the cutting tip of the at least one cutter element has a substantially planar surface perpendicular to the cutter element axis.

32. The drill bit of claim 20 further comprising:

a first circumferential row of inner row cutter elements;

a second circumferential row of gage row cutter elements;

wherein at least one of the gage row cutter elements is positioned in the cone cutter to cut against the borehole sidewall and has a tip-to-base volume ratio of at least 0.30.

33. The drill bit of claim 20 wherein the base portion has a non-circular cross-section.

34. The drill bit of claim 20 wherein the at least one cutter element comprises a cutter element axis and wherein the cutting portion is asymmetric relative to the cutter element axis.

35. The drill bit of claim 20 wherein at least a portion of the cutting portion extends laterally beyond the base portion.

36. The drill bit of claim 20 wherein the base portion comprises a base axis and the cutting portion comprises a cutting axis, wherein the base axis and the cutting axis are oriented at an acute angle relative to one another.

37. The drill bit of claim 20 wherein the base portion comprises a base axis and the cutting portion comprises a cutting axis, wherein the base axis and the cutting axis are parallel.

38. The drill bit of claim 37 wherein the cutting axis is laterally offset from the base axis.

39. The drill bit of claim 20, wherein the tip-to-base volume ratio of the at least one cutter element is at least 0.30.

40. The drill bit of claim 39 wherein the tip-to-base volume ratio of the at least one cutter element is greater than 0.75.

41. The drill bit of claim 40 wherein the at least one cutter element comprises a substantially planar cutting surface at the extension height that is substantially perpendicular to the cutter element axis.

42. The drill bit of claim 39 wherein the base portion has a non-circular cross-section.

43. A rolling cone drill bit for drilling through earthen formations to form a borehole having a hole bottom and a hole sidewall, the drill bit comprising:

at least one rolling cone cutter rotatably mounted on a bit body for rotation about a cone axis;

a plurality of inner row cutter elements mourned in the cone cutter in a first circumferential row, the inner row cutter elements having a generally conical cutting portion extending from a cylindrical base with a base diameter to a cutting tip and defining an extension height, wherein the ratio of the extension height to the base diameter of the inner row cutter elements is not greater than 0.75;

a plurality of gage row cutter elements mounted in the cone cutter in a second circumferential row, the gage row cutter elements having a cutting portion extending from a generally cylindrical base with a base diameter to a cutting tip and defining an extension height, wherein the ratio of the extension height to the base diameter of the gage row cutter elements are not greater than 0.5; and wherein the plurality of inner row cutter elements and the plurality of gage row cutter elements each include a tip-to-base volume ratio of at least 0.17;

wherein a plurality of the inner row cutter elements have a ratio of cross-sectional area at 94% of the extension height to the cross-sectional area of the inner row cutter element base that is at least 0.2.

44. The drill bit of claim 43 wherein a plurality of the inner row cutter elements include a cutting portion comprising a crest.

45. The drill bit of claim 43 wherein a plurality of the inner row cutter elements include a cutting surface having a side surface, a tip surface, and an intermediate surface extending between the side and tip surfaces, and wherein the side surface, intermediate surface, and tip surface are all convex.

46. The drill bit of claim 45 wherein the tip surface includes a radius of curvature that is greater than the diameter of the cutter element.

47. The drill bit of claim 43 wherein the gage row cutter elements include a wear face and a contiguous trailing face, and wherein the gage row cutter elements are oriented in the cone cutter such that the wear face is generally facing the borehole sidewall and the trailing face tapers away from the borehole sidewall.

48. The drill bit of claim 43 wherein a plurality of the gage row cutter elements have a ratio of cross-sectional area at 94% of the extension height to the cross-sectional area of the gage element base that is at least 0.35.

49. The drill bit of claim 43 wherein a plurality of the gage row cutter elements have a ratio of cross-sectional area at 75% of the extension height to the cross-sectional area of the gage cutter element base that is at least 0.5.

50. The drill bit of claim 43 wherein the drill bit has an IADC classification of at least Series 5.

51. A method of designing a rolling cone drill bit for forming a borehole, the method comprising:

selecting a rolling cone cutter;

selecting a location on the rolling cone cutter for mounting a cutting insert having a base portion retained in the cone cutter and a cutting portion extending therefrom to cut a portion of the borehole bottom;

selecting the diameter for the base portion;

selecting the extension height for the cutting portion;

selecting the geometry of the cutting portion such that the cutting insert has a tip volume of at least 0.0010 $in^3$; and selecting the geometry such that the cross-sectional area of the cutting portion taken at a plane that is 94% of the extension height is at least 20% of the cross-sectional area of the base.

52. The method of claim 51 further comprising selecting the diameter and extension height such that the ratio of extension height to diameter is not greater than 0.75.

53. The drill bit of claim 51 wherein the cutting insert includes a cutting tip including an annular ridge disposed about a hollow region.

* * * * *